US010877391B2

(12) United States Patent
Matsuo et al.

(10) Patent No.: US 10,877,391 B2
(45) Date of Patent: Dec. 29, 2020

(54) MAGNETIC CARRIER, TWO-COMPONENT DEVELOPER, REPLENISHING DEVELOPER, AND IMAGE FORMING METHOD

(71) Applicant: CANON KABUSHIKI KAISHA, Tokyo (JP)

(72) Inventors: Ryuichiro Matsuo, Moriya (JP); Nobuyoshi Sugahara, Tokyo (JP); Hironori Minagawa, Moriya (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/531,306

(22) Filed: Aug. 5, 2019

(65) Prior Publication Data

US 2020/0050124 A1 Feb. 13, 2020

(30) Foreign Application Priority Data

Aug. 8, 2018 (JP) ..... 2018-149543

(51) Int. Cl.
*G03G 9/113* (2006.01)
*G03G 15/08* (2006.01)
(Continued)

(52) U.S. Cl.
CPC ..... *G03G 9/1133* (2013.01); *G03G 9/1075* (2013.01); *G03G 15/0868* (2013.01); *G03G 15/0921* (2013.01)

(58) Field of Classification Search
CPC ..... G03G 9/113; G03G 9/1132; G03G 9/1133
See application file for complete search history.

(56) References Cited

U.S. PATENT DOCUMENTS 5,437,949 A 8/1995 Kanbayashi et al.
5,512,402 A 4/1996 Okado et al.
(Continued)

FOREIGN PATENT DOCUMENTS

EP 2990874 A1 * 3/2016 ..... G03G 9/107
JP 2009-237525 10/2009
JP 2010-145470 7/2010

OTHER PUBLICATIONS

U.S. Appl. No. 16/526,501, Nobuyoshi Sugahara, filed Jul. 30, 2019.

(Continued)

*Primary Examiner* — Peter L Vajda
(74) *Attorney, Agent, or Firm* — Venable LLP

(57) ABSTRACT

A magnetic carrier including a magnetic carrier particle having a magnetic carrier core and a resin coating layer formed on a surface of the magnetic carrier core, wherein the resin coating layer includes a resin component including a resin A and a resin B, the resin A is a copolymer of monomers including (a) a (meth)acrylic acid ester monomer having an alicyclic hydrocarbon group and (b) a specific macromonomer, the resin B is a copolymer of monomers including (c) a styrene-based monomer and (d) a specific (meth)acrylic acid ester monomer, and in a molecular weight distribution of a THF soluble component of the resin component contained in the resin coating layer, a peak derived from the resin B is present in a molecular weight range of from 1000 to 9500.

11 Claims, 6 Drawing Sheets

(51) Int. Cl.
*G03G 15/09* (2006.01)
*G03G 9/107* (2006.01)

(56) References Cited

U.S. PATENT DOCUMENTS

| | | | |
|---|---|---|---|
| 5,607,806 | A | 3/1997 | Kanbayashi et al. |
| 5,635,326 | A | 6/1997 | Kanbayashi et al. |
| 5,700,617 | A | 12/1997 | Takiguchi et al. |
| 5,747,209 | A | 5/1998 | Takiguchi et al. |
| 5,851,714 | A | 12/1998 | Taya et al. |
| 5,912,099 | A | 6/1999 | Kanbayashi et al. |
| 5,922,500 | A | 7/1999 | Iida et al. |
| 5,994,018 | A | 11/1999 | Iida et al. |
| 6,013,402 | A | 1/2000 | Kanbayashi et al. |
| 6,022,659 | A | 2/2000 | Kanbayashi et al. |
| 6,077,635 | A | 6/2000 | Okado |
| 6,326,114 | B1 | 12/2001 | Itakura et al. |
| 6,528,222 | B2 | 3/2003 | Kohtaki et al. |
| 6,586,147 | B2 | 7/2003 | Iida et al. |
| 6,664,016 | B2 | 12/2003 | Kanbayashi et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,320,850 | B2 | 1/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,455,947 | B2 | 11/2008 | Ida et al. |
| 7,536,132 | B2 | 5/2009 | Minagawa |
| 7,816,063 | B2 | 10/2010 | Hashimoto et al. |
| 8,945,805 | B2 | 2/2015 | Baba et al. |
| 9,046,800 | B2 | 6/2015 | Hotta et al. |
| 9,075,328 | B2 | 7/2015 | Minagawa et al. |
| 9,158,217 | B2 | 10/2015 | Takahashi et al. |
| 9,372,420 | B2 | 6/2016 | Mizo et al. |
| 9,454,094 | B2 | 9/2016 | Tsujimoto et al. |
| 9,500,975 | B2 | 11/2016 | Sugahara et al. |
| 9,599,920 | B2 | 3/2017 | Sugahara et al. |
| 9,606,466 | B2 | 3/2017 | Takahashi et al. |
| 9,665,021 | B2 | 5/2017 | Ohtsu et al. |
| 9,665,023 | B2 | 5/2017 | Kamae et al. |
| 9,671,707 | B2 | 6/2017 | Minagawa et al. |
| 9,703,216 | B2 | 7/2017 | Tsuchida et al. |
| 9,778,598 | B2 | 10/2017 | Onozaki et al. |
| 9,785,070 | B2 | 10/2017 | Sugahara et al. |
| 9,915,885 | B2 | 3/2018 | Kastumata et al. |
| 9,958,809 | B2 | 5/2018 | Sugahara et al. |
| 9,969,834 | B2 | 5/2018 | Ohtsu et al. |
| 10,007,206 | B2 | 6/2018 | Sugahara et al. |
| 10,012,918 | B2 | 7/2018 | Ishigami et al. |
| 10,012,921 | B2 | 7/2018 | Kamae et al. |
| 10,133,201 | B2 | 11/2018 | Kamae et al. |
| 10,216,108 | B2 | 2/2019 | Iwasaki et al. |
| 10,234,777 | B2 | 3/2019 | Ohtsu et al. |
| 10,409,188 | B2 | 9/2019 | Sugahara et al. |
| 10,423,090 | B2 | 9/2019 | Ohtsu et al. |
| 10,451,985 | B2 | 10/2019 | Takahashi et al. |
| 2014/0137428 | A1 | 5/2014 | Takenaka et al. |
| 2018/0275540 | A1 | 9/2018 | Matsuo et al. |
| 2019/0155182 | A1 | 5/2019 | Watanabe et al. |

OTHER PUBLICATIONS

U.S. Appl. No. 16/539,245, Ryuji Murayama, filed Aug. 13, 2019.
U.S. Appl. No. 16/550,418, Daisuke Tsujimoto, filed Aug. 26, 2019.
U.S. Appl. No. 15/550,452, Takeshi Ohtsu, filed Aug. 26, 2019.
U.S. Appl. No. 16/571,427, Nobuyoshi Sugahara, filed Sep. 16, 2019.

* cited by examiner

MAGNETIC CARRIER, TWO-COMPONENT DEVELOPER, REPLENISHING DEVELOPER, AND IMAGE FORMING METHOD

BACKGROUND OF THE INVENTION

Field of the Invention

The present invention relates to a magnetic carrier, a two-component developer, and a replenishing developer to be used in an image forming method for visualizing an electrostatic charge image by using electrophotography, and to an image forming method using the same.

Description of the Related Art

Conventionally, a method of forming an electrostatic latent image by using various means on an electrostatic latent image bearing member, attaching a toner to the electrostatic latent image, and developing the electrostatic latent image have been generally used as an electrophotographic image forming method. A two-component development system in which carrier particles called magnetic carrier are mixed with a toner and triboelectrically charged to apply a suitable amount of positive or negative charge to the toner, and development is performed using the charge as a driving force has been widely used in such development.

The merit of the two-component development method is that functions such as stirring, transport, and charging of the developer can be imparted to the magnetic carrier, so that functions can be clearly divided between the magnetic carrier and the toner, thereby ensuring satisfactory controllability of the developer performance.

Meanwhile, in recent years, technological advances in the field of electrophotography created an ever-growing demand for a higher speed and longer lifer of devices and also for higher definition and stable image quality. In order to meet such demands, higher performance of magnetic carriers is needed.

To satisfy this need, Japanese Patent Application Publication No. 2009-237525 suggests to reduce concentration fluctuations, in particular, even in long-term use under high temperature and high humidity and to stabilize the charge quantity even when the developer is allowed to stand for a long time. This carrier is characterized in that a copolymer of a specific (meth)acrylic acid monomer and a macromonomer is used as a coating resin. As a result, although the above problem is somewhat resolved, in an environment where stable image quality is required even in high-speed copying and at high image density, as in recent years, a larger amount of toner is replenished to the developing device and adhesion of toner or an external additive present on the toner particle surface to the resin coating layer is promoted. Therefore, in addition to enhancing the toughness and abrasion resistance of the resin coating layer, further improvement is required to increase the image quality and adaptability to environmental changes.

In view of the above, Japanese Patent Application Publication No. 2010-145470 suggests restricting the weight average molecular weight of the coating resin and using the coating resin in which the amount of low molecular weight components is reduced.

SUMMARY OF THE INVENTION

With the magnetic carrier described in the above-mentioned patent literature, the problems such as the improvement of image quality and adaptability to environmental changes are improved.

However, in the market, particularly in the on-demand printer field, there is a growing demand that images with high character quality be stably obtained even in long-term use without uneven density in the image plane. There is an urgent need to develop a magnetic carrier, a two-component developer, and an image forming method using the same that satisfy this demand.

An object of the present invention is to provide a magnetic carrier that resolves such problems. Specifically, to provide a magnetic carrier, a two-component developer, a replenishing developer, and an image forming method using the same that suppress density unevenness in the image plane and a decrease in fine line reproducibility and make it possible to obtain images without unevenness and high-quality character images stably even in long-term use.

The inventors of the present invention have found that by using a magnetic carrier including a magnetic carrier particle having a resin coating layer such as shown hereinbelow, it is possible to suppress density unevenness in the image plane and the decrease in fine line reproducibility and to obtain images without unevenness and high-quality character images stably even in long-term use.

That is, the present invention provides a magnetic carrier including a magnetic carrier particle having a magnetic carrier core and a resin coating layer formed on a surface of the magnetic carrier core, wherein the resin coating layer includes a resin component including a resin A and a resin B, the resin A is a copolymer of monomers including (a) a (meth)acrylic acid ester monomer having an alicyclic hydrocarbon group, and (b) a macromonomer containing a polymer portion and a reactive portion bound to the polymer portion, wherein the polymer portion has a polymer of at least one monomer selected from the group consisting of methyl acrylate, methyl methacrylate, butyl acrylate, butyl methacrylate, 2-ethylhexyl acrylate and 2-ethylhexyl methacrylate, and the reactive portion has a reactive C—C double bond, the resin B is a copolymer of monomers including (c) a styrene-based monomer, and (d) a (meth)acrylic acid ester monomer represented by a following formula (1), and in a molecular weight distribution of a tetrahydrofuran soluble component of the resin component contained in the resin coating layer, a peak derived from the resin B is present in a molecular weight range of from 1000 to 9500.

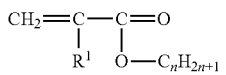

(1)

In the formula (1), $R^1$ represents H or $CH_3$, and n represents an integer of from 2 to 8.

The present invention also relates to a two-component developer including a toner comprising a toner particle including a binder resin, and a magnetic carrier, wherein the magnetic carrier is the abovementioned magnetic carrier.

The present invention also relates to a replenishing developer for use in an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which the replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the abovementioned magnetic carrier.

The present invention also relates to an image forming method comprising:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, wherein the two-component developer is the abovementioned two-component developer.

The present invention also relates to an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which a replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the abovementioned magnetic carrier.

According to the present invention, it is possible to suppress density unevenness in the image plane and the decrease in fine line reproducibility and to obtain images without unevenness and high-quality character images stably even in long-term use.

Further features of the present invention will become apparent from the following description of exemplary embodiments with reference to the attached drawings.

DESCRIPTION OF THE EMBODIMENTS

Figure 1:
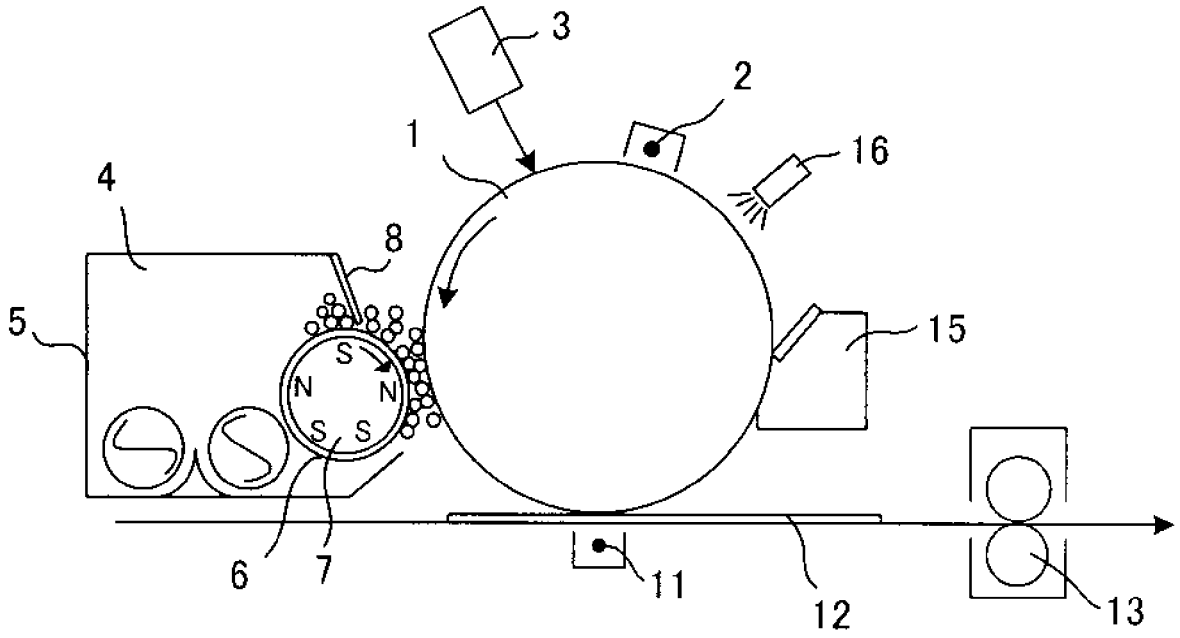
FIG. 1 is a schematic view of an image forming apparatus.

In the present invention, the expressions "from XX to YY" or "XX to YY" representing a numerical range mean a numerical range including the lower limit and the upper limit which are endpoints, unless otherwise noted.

In the present invention, a (meth)acrylic acid ester means an acrylic acid ester and/or a methacrylic acid ester.

The magnetic carrier of the present invention has a magnetic carrier particle having a magnetic carrier core and a resin coating layer formed on a surface of the magnetic carrier core, wherein the resin coating layer includes a resin component including a resin A and a resin B, the resin A is a copolymer of monomers including (a) a (meth)acrylic acid ester monomer having an alicyclic hydrocarbon group, and (b) a macromonomer containing a polymer portion and a reactive portion bound to the polymer portion, wherein the polymer portion has a polymer of at least one monomer selected from the group consisting of methyl acrylate, methyl methacrylate, butyl acrylate, butyl methacrylate, 2-ethylhexyl acrylate and 2-ethylhexyl methacrylate, and the reactive portion has a reactive C—C double bond, the resin B is a copolymer of monomers including (c) a styrene-based monomer, and (d) a (meth)acrylic acid ester monomer represented by a following formula (1), and in a molecular weight distribution of a tetrahydrofuran soluble component of the resin component contained in the resin coating layer, a peak derived from the resin B is present in a molecular weight range of from 1000 to 9500.

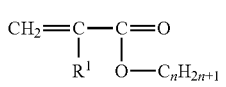

(1)

(In the formula (1), $R^1$ represents H or $CH_3$, and n represents an integer of from 2 to 8).

Usually, when the mode of use is switched from long-term use at low print density to use at high print density, excessive charging of a developer, particularly a toner, occurs. Accordingly, a difference occurs between the charge quantity of the toner present in the developing device and the charge quantity of the toner immediately after being supplied to the developing device. As a result, density unevenness in the image plane and decrease in character quality due to the decrease in fine line reproducibility occur.

There is a method for improving charge relaxation property and suppressing the density unevenness in the image plane and the decrease in character quality by using a resin having a low molecular weight for the coating resin of the magnetic carrier. However, since the molecular weight of the coating resin is lowered, the toughness of the resin coating layer itself is lowered, and the charging performance of the developer deteriorates in long-term use. In particular, in a high-temperature and high-humidity environment, a change in image density after initial use and long-term use can be large.

The inventors of the present invention have conducted a comprehensive study for the purpose of achieving both the extension of the developer life and the suppression of density unevenness in the image plane and of the decrease in character quality due to the decrease in fine line reproducibility during long-term use. As a result, it has been found that the magnetic carrier of the above configuration is important.

The mechanism by which the magnetic carrier of the present invention can resolve the abovementioned problems is considered hereinbelow.

Since the steric hindrance of the monomer unit in the vicinity of the end of the macromonomer of the resin A is smaller than that of the monomer units constituting the main chain, the end portion of the macromonomer portion of the resin A and the magnetic carrier core surface easily come into contact with each other. Therefore, a gap is formed between the macromonomer portions of the resin A due to interaction between the ester bond portion at the end portion of the resin A and the hydroxyl group present on the surface of the magnetic carrier core. The resin B, which is a low molecular weight resin, penetrates into the gap, whereby the charge relaxation property derived from the resin B can be exhibited. Furthermore, since only the resin A tends to present on the surface of the magnetic carrier coated with the resin coating layer, the toughness and the abrasion resistance of the resin coating layer can be improved.

From the viewpoint of prolonging the life and suppressing the density unevenness in the image plane and the decrease in fine line reproducibility, it is necessary that in a molecular weight distribution of a tetrahydrofuran soluble component of the resin component contained in the resin coating layer, which is determined by gel permeation chromatography (GPC), a peak derived from the resin B be present in a molecular weight range of from 1000 to 9500. It is preferable that the peak derived from the resin B be present in a molecular weight range of from 2000 to 9000. When the peak derived from the resin B is less than 1000 in molecular weight, the toughness and abrasion resistance of the resin coating layer may be reduced, peeling or scraping of the resin coating layer may occur during long-term use, and the image density tends to change. Meanwhile, when the peak derived from the resin B is larger than 9500 in molecular weight, the charge relaxation property derived from the resin B is not sufficiently expressed, so that the density unevenness in the image plane and the fine line reproducibility tend to decrease.

Further, in the molecular weight distribution of the tetrahydrofuran soluble component of the resin component contained in the resin coating layer, which is determined by gel permeation chromatography, it is preferable that a peak derived from the resin A be present in a molecular weight range of from 25,000 to 70,000, and more preferably in a molecular weight range of from 40,000 to 60,000. When the peak derived from the resin A is 25,000 or more in molecular weight, the toughness and abrasion resistance of the resin coating layer can be maintained, peeling and scraping of the resin coating layer can be suppressed during long-term use, and changes in image density can also be suppressed. Meanwhile, when the peak derived from the resin A is 70,000 or less in molecular weight, the charge relaxation property of the resin coating layer is sufficiently obtained, and density unevenness in the image plane and the decrease in fine line reproducibility are suppressed.

Resin A

The resin A used for the resin coating layer is a vinyl-based resin which is a copolymer of monomers including a vinyl-based monomer having a cyclic hydrocarbon group in a molecular structure and another vinyl-based monomer. Among them, it is necessary that the resin A is a copolymer of a (meth)acrylic ester having an alicyclic hydrocarbon group and a monomer including a specific macromonomer. A monomer other than the (meth)acrylic acid ester having an alicyclic hydrocarbon group and the specific macromonomer may also be used to the extent that the effects of the present invention are not impaired.

In the resin A, the polymer portion of the monomer including a (meth)acrylic acid ester having an alicyclic hydrocarbon group makes the coated surface of the resin layer coated on the surface of the magnetic carrier core smooth. As a result, this portion acts to suppress the adhesion of a toner-derived component to the magnetic carrier and to suppress the decrease of charging performance. In addition, the macromonomer portion improves the adhesion with the magnetic carrier core, thereby improving the image density stability. Furthermore, charge leakage in the coated thin layer portion can be reduced in a high-humidity environment over a long period of time, and the density after storage and fine line reproducibility can be stabilized.

Examples of the (meth)acrylic acid ester (monomer) having an alicyclic hydrocarbon group include cyclobutyl acrylate, cyclopentyl acrylate, cyclohexyl acrylate, cycloheptyl acrylate, dicyclopentenyl acrylate, dicyclopentanyl acrylate, cyclobutyl methacrylate, cyclopentyl methacrylate, cyclohexyl methacrylate, cycloheptyl methacrylate, dicyclopentenyl methacrylate, dicyclopentanyl methacrylate and the like. The alicyclic hydrocarbon group is preferably a cycloalkyl group, and the carbon number is preferably from 3 to 10, and more preferably from 4 to 8. One or two or more of these may be selected and used.

The macromonomer contains a polymer portion and a reactive portion bound to the polymer portion. The polymer portion has a polymer of at least one monomer selected from the group consisting of methyl acrylate, methyl methacrylate, butyl acrylate, butyl methacrylate, 2-ethylhexyl acrylate, and 2-ethylhexyl methacrylate. The reactive portion has a reactive C—C double bond. The macromonomer can be exemplified by a polymer of at least one monomer selected from the group consisting of methyl acrylate, methyl methacrylate, butyl acrylate, butyl methacrylate, 2-ethylhexyl acrylate, and 2-ethylhexyl methacrylate. Example of the reactive portion having reactive C—C double bond includes vinyl group, acryloyl group and methacryloyl group.

Where, among the monomers for forming the resin A, a ratio of the (meth)acrylic acid ester monomer having an alicyclic hydrocarbon group is denoted by Ma (% by mass), and a ratio of the macromonomer is denoted by Mb (% by mass), it is preferable that 50.0≤Ma≤90.0 and 10.0≤Mb≤50.0, and more preferably 60.0≤Ma≤85.0 and 15.0≤Mb≤40.0.

By setting Ma to 50.0% by mass or more, the toughness and abrasion resistance of the resin coating layer can be maintained, peeling and scraping of the resin coating layer can be suppressed during long-term use, and changes in image density can also be suppressed. Meanwhile, by setting Ma to 90.0% by mass or less, the charge relaxation property of the resin coating layer is sufficiently obtained, and density unevenness in the image plane and the decrease in fine line reproducibility are suppressed.

Further, by setting Mb to 10.0% by mass or more, the charge relaxation property of the resin coating layer is sufficiently obtained, and density unevenness in the image plane and the decrease in fine line reproducibility are suppressed. Meanwhile, by setting the Mb to 50.0% by mass or more, the toughness and abrasion resistance of the resin coating layer can be maintained, peeling and scraping of the resin coating layer can be suppressed during long-term use, and the change in image density can also be suppressed.

From the viewpoint of stability of the coating, the weight average molecular weight (Mw) of the resin A is preferably from 20,000 to 75,000, and more preferably from 25,000 to 70000.

In the resin A, a (meth)acrylic monomer other than the (meth)acrylic acid ester having an alicyclic hydrocarbon group and the macromonomer may be used as a monomer.

Examples of the other (meth)acrylic monomer include methyl acrylate, methyl methacrylate, ethyl acrylate, ethyl methacrylate, butyl acrylate (n-butyl, sec-butyl, iso-butyl or tert-butyl; the same applies hereinafter), butyl methacrylate, 2-ethylhexyl acrylate, 2-ethylhexyl methacrylate, acrylic acid, methacrylic acid and the like.

The ratio of the other (meth)acrylic monomer is preferably 0.1% by mass to 2.0% by mass, and more preferably 0.1% by mass to 1.0% by mass.

The weight average molecular weight Mw of the macromonomer determined by gel permeation chromatography is preferably from 1000 to 9500. When the weight average molecular weight of the macromonomer is 1000 or more, the above-mentioned penetration of the resin B into the macromonomer portion is more effectively developed, the toughness and abrasion resistance of the resin coating layer are improved, and the change in image density is further suppressed. Meanwhile, when the weight average molecular weight is 9500 or less, the charge relaxation property of the resin coating layer is sufficiently obtained, and density unevenness in the image plane and the decrease in fine line reproducibility are suppressed.

Resin B

The resin B is a copolymer of a monomer including a styrene-based monomer and a (meth)acrylic acid ester monomer represented by the formula (1). By including the styrene-based monomer in the copolymer, it is possible to increase the glass transition point even with the same molecular weight as compared with a resin containing no styrene-based monomer, and the toughness of the resin coating layer can be maintained even with a low molecular weight. To the extent that the effects of the present invention are not impaired, other monomers other than the styrene-based monomer and the (meth)acrylic acid ester monomer represented by the formula (1) may be used.

Further, by including the (meth)acrylic acid ester monomer represented by the formula (1), the affinity with the macromonomer of the resin A having a similar structure is enhanced. Therefore, as described above, the penetration of the resin B into the macromonomer portion is more effectively developed, and both the improvement of toughness and abrasion resistance of the resin coating layer and the suppression of density unevenness in the image plane and of the decrease in fine line reproducibility can be achieved.

The styrene-based monomer is not particularly limited, and suitable examples thereof are presented hereinbelow.

Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene and the like.

The resin used as the resin B is not particularly limited. Examples of suitable resins include styrene copolymers such as a styrene-ethyl acrylate copolymer, a styrene-butyl acrylate copolymer, a styrene-octyl acrylate copolymer, a styrene-ethyl methacrylate copolymer, a styrene-butyl methacrylate copolymer, a styrene-octyl methacrylate copolymer and the like. These may be used singly or in combination of two or more types thereof.

The weight average molecular weight (Mw) of the resin B is preferably from 1000 to 9500, and more preferably from 1500 to 9000. When the Mw of the resin B is 1000 or more, the toughness and abrasion resistance of the resin coating layer are further improved, and a change in image density is further suppressed. Meanwhile, when the Mw of the resin B is 9500 or less, density unevenness in the image plane and the decrease in fine line reproducibility are further suppressed.

When, among the monomers for forming the resin B, a mass-based ratio of the (meth)acrylic acid ester monomer represented by the formula (1) is denoted by Mc (ppm), Mc preferably satisfies 5≤Mc≤6000, and more preferably 10≤Mc≤5000.

By setting Mc in the above range, the toughness of the resin coating layer is increased and also the affinity between the monomer portion and the (meth)acrylic acid ester macromonomer portion represented by the formula (1) is further increased and both the improvement of toughness and abrasion resistance of the resin coating layer and the suppression of density unevenness in the image plane and of the decrease in fine line reproducibility can be achieved.

Meanwhile, among the monomers for forming the resin B, the ratio of the styrene-based monomer is preferably from 99.4000% by mass to 99.9995% by mass, and more preferably from 99.5000% by mass to 99.9990% by mass.

The amount of the resin coating layer is preferably from 1.0 part by mass to 3.0 parts by mass with respect to 100 parts by mass of the magnetic carrier core. When the amount is 1.0 part by mass or more, the toughness and abrasion resistance of the resin are increased and a change in the image density is suppressed. Meanwhile, when the amount is 3.0 parts by mass or less, the charge relaxation property is further enhanced, and density unevenness in the image plane and the decrease in fine line reproducibility are further suppressed.

When the content ratio of the resin A in the resin coating layer is denoted by MA (% by mass) and the content ratio of the resin B in the resin coating layer is denoted by MB (% by mass), the MA and MB satisfy the following relationships:

$$10.0 \leq MA \leq 99.0 \text{ and}$$

$$1.0 \leq MB \leq 90.0$$

By satisfying the above ranges, the affinity between the resin A and the resin B is further enhanced, and both the improvement of toughness and abrasion resistance of the resin coating layer and the suppression of density unevenness in the image plane and of the decrease in fine line reproducibility can be achieved.

More preferably, $50.0 \leq MA \leq 80.0$ and $20.0 \leq MB \leq 50.0$.

For the magnetic carrier, it is preferable that a current value at the time of 500 V application be from 10.0 μA to 100.0 μA. When the current value is 10.0 μA or more, density unevenness in the image plane and the decrease in character quality are further suppressed. Meanwhile, when the current value is 100.0 μA or less, it is possible to suppress so-called "fogging" in which toner which is not sufficiently charged is transferred to the non-image portion.

The magnetic carrier preferably has a specific resistance value at an electric field strength of 2000 V/cm of from $1.0\times10^5$ Ω·cm to $1.0\times10^{10}$ Ω·cm. When the specific resistance value is $1.0\times10^5$ Ω·cm or more, "fogging" is suppressed, and when the specific resistance value is $1.0\times10^{10}$ Ω·cm or less, density unevenness in the image surface and the decrease in character quality are further suppressed.

Next, the magnetic carrier core used in the present invention will be described.

A well-known magnetic carrier core can be used as the magnetic carrier core used for the magnetic carrier of this invention. It is more preferable to use a magnetic body-dispersed resin particle in which a magnetic body is dispersed in a resin component, or a porous magnetic core particle including a resin in a void portion.

These can reduce the true density of the magnetic carrier, and hence can reduce the load on the toner. As a result, even in long-term use, the deterioration of image quality is small and it is possible to reduce the replacement frequency of the developer composed of the toner and the carrier. However, these magnetic carrier cores are not limiting, and the effects of the present invention can be sufficiently exhibited even if a commercially available magnetic carrier core is used.

Examples of the magnetic body component to be used for the magnetic body-dispersed resin particle include various magnetic iron compound particle powders such as magnetite particle powder, maghemite particle powder, and magnetic iron oxide particle powder obtained by including at least one selected from silicon oxide, silicon hydroxide, aluminum oxide, and aluminum hydroxide therein; magnetoplumbite type ferrite particle powder including barium, strontium or barium-strontium; spinel type ferrite particle powder including at least one selected from manganese, nickel, zinc, lithium and magnesium; and the like.

Among these, magnetic iron oxide particle powders are preferably used.

In addition to the magnetic body component, nonmagnetic iron oxide particle powder such as hematite particle powder, nonmagnetic hydrous ferric oxide particle powder such as goethite particle powder, and nonmagnetic inorganic compound particle powder such as titanium oxide particle powder, silica particle powder, talc particle powder, alumina particle powder, barium sulfate particle powder, barium carbonate particle powder, cadmium yellow particle powder, calcium carbonate particle powder, zinc oxide particle powder, and the like may be used in combination with the magnetic iron compound particle powder.

When the magnetic iron compound particle powder and the nonmagnetic inorganic compound particle powder are used in a mixture, it is preferable that the magnetic iron compound particle powder be included at a mixing ratio of at least 30% by mass.

It is preferable that the magnetic iron compound particle powder be entirely or partially treated with a lipophilic agent.

In this case, an organic compound having one or two or more functional groups such as an epoxy group, an amino group, a mercapto group, an organic acid group, an ester group, a ketone group, a halogenated alkyl group and an aldehyde group, or a mixture of such organic compounds can be used for the lipophilic treatment.

The organic compound having a functional group is preferably a coupling agent, more preferably a silane coupling agent, a titanium coupling agent and an aluminum coupling agent, and a silane coupling agent is particularly preferable.

A thermosetting resin is preferable as a binder resin constituting the magnetic body-dispersed resin particle. For example, a phenol resin, an epoxy resin, an unsaturated polyester resin and the like can be used, but from the viewpoint of inexpensiveness and easiness of the production method, it is preferable that a phenol resin be included. For example, a phenol-formaldehyde resin can be mentioned.

The content ratio of the binder resin and the magnetic iron compound particle powder (or the mixture of the magnetic iron compound particle powder and the nonmagnetic inorganic compound particle powder) constituting the composite particle in the present invention is preferably from 1% by mass to 20% by mass of the binder resin and from 80% by mass to 99% by mass of the magnetic iron compound particle powder (or the mixture).

Next, a method for producing the magnetic body-dispersed resin particle will be described.

A phenol and an aldehyde are stirred in an aqueous medium in the presence of magnetic and nonmagnetic inorganic compound particle powders and a basic catalyst, for example, as indicated in Examples described hereinbelow. Then, the phenol and the aldehyde are reacted and cured to generate a composite particle including an inorganic compound particle such as magnetic iron particle powder and a phenol resin.

Moreover, the magnetic body-dispersed resin particle can be also manufactured by the so-called knead-pulverizing method by which a binder resin including inorganic compound particles such as magnetic iron oxide particle powder is pulverized. The former method is preferred because the particle diameter of the magnetic carrier can be easily controlled and a sharp particle diameter distribution can be obtained.

Next, a porous magnetic core particle will be described.

As a material of the porous magnetic core particle, magnetite or ferrite is preferable. Furthermore, ferrite is more preferable as the material of the porous magnetic core particle because the porous structure of the porous magnetic core particle can be controlled and the resistance can be adjusted.

Ferrite is a sintered body represented by a following general formula.

$$(M1_2O)_x(M2O)_y(Fe_2O_3)_z$$

(wherein, M1 is a monovalent metal, M2 is a divalent metal, and x and y each satisfy $0 \leq (x, y) \leq 0.8$ where $x+y+z=1.0$, and z is $0.2<z<1.0$)

In the formula, at least one metal atom selected from the group consisting of Li, Fe, Mn, Mg, Sr, Cu, Zn, Ca is preferably used as M1 and M2. In addition, Ni, Co, Ba, Y, V, Bi, In, Ta, Zr, B, Mo, Na, Sn, Ti, Cr, Al, Si, rare earths and the like can be used.

In the magnetic carrier, it is preferable to maintain the appropriate amount of magnetization and to control the unevenness state of the surface of the porous magnetic core particle in order to bring the fine pore diameter into a desired range. In addition, it is preferable that the rate of the ferritization reaction could be easily controlled, and the specific resistance and magnetic force of the porous magnetic core could be suitably controlled. From the above viewpoints, a Mn-based ferrite, a Mn-Mg-based ferrite, a Mn-Mg-Sr-based ferrite, and a Li-Mn-based ferrite including a Mn element are more preferable. A manufacturing process implemented in the case of using a porous ferrite particle as a magnetic carrier core is explained hereinbelow in detail.

Step 1 (Weighing and Mixing Step)

The raw materials of the above ferrite are weighed and mixed. The ferrite raw materials can be exemplified by metal particle of the abovementioned metal elements, or oxides, hydroxides, oxalates, carbonates and the like thereof.

Examples of an apparatus for mixing are presented hereinbelow. A ball mill, a planetary mill, a Giotto mill, and a vibration mill. In particular, a ball mill is preferable from the viewpoint of mixability.

Specifically, the weighed ferrite raw materials and balls are placed in a ball mill, and pulverized and mixed, preferably for 0.1 h to 20.0 h.

Step 2 (Pre-Baking Step)

The pulverized and mixed ferrite raw materials are pre-baked in the air or in a nitrogen atmosphere, preferably at a baking temperature of from 700° C. to 1200° C., preferably for 0.5 h to 5.0 h, to form a ferrite. For example, the following furnace is used for firing. A burner type baking furnace, a rotary type baking furnace, an electric furnace and the like.

Step 3 (Pulverization Step)

The pre-baked ferrite produced in step 2 is pulverized in a pulverizer. The pulverizer is not particularly limited as long as a desired particle diameter can be obtained. For example, the following can be mentioned. A crusher, a hammer mill, a ball mill, a bead mill, a planetary mill, a Giotto mill and the like.

In order to obtain the desired particle diameter of the pulverized ferrite product, it is preferable to control the material of the balls or beads used in a ball mill or bead mill, the particle diameter, and the operation time. Specifically, in order to reduce the particle diameter of the pre-baked ferrite slurry, balls with a high specific gravity may be used or the pulverizing time may be lengthened. Moreover, in order to widen the particle size distribution of the pre-baked ferrite, balls or beads with a high specific gravity may be used or the pulverizing time can be lengthened. Also, by mixing a plurality of pre-baked ferrites different in particle diameter, it is possible to obtain a pre-baked ferrite having a wide distribution.

Further, in the ball mill and bead mill, a wet method is superior to a dry method in that the pulverized product does not fly up in the mill and the pulverizing efficiency is high. Therefore, the wet method is more preferable than the dry method.

Step 4 (Granulation Step)

Water, a binder and, if necessary, a pore regulator are added to the pulverized product of pre-baked ferrite. The pore regulator can be exemplified by a foaming agent and fine resin particles.

The foaming agent can be exemplified by sodium hydrogencarbonate, potassium hydrogencarbonate, lithium hydrogencarbonate, ammonium hydrogencarbonate, sodium carbonate, potassium carbonate, lithium carbonate, and ammonium carbonate.

The fine resin particles can be exemplified by polyesters, polystyrene, and styrene copolymers such as styrene-vinyl toluene copolymer, styrene-vinyl naphthalene copolymer, styrene-acrylic acid ester copolymer, styrene-methacrylic acid ester copolymer, styrene-α-chloromethacrylic acid, styrene-acrylonitrile copolymer, styrene-vinyl methyl ketone copolymer, styrene-butadiene copolymer, styrene-isoprene copolymer, styrene-acrylonitrile-indene copolymer and the like; polyvinyl chloride, phenol resins, modified phenol resins, maleic resins, acrylic resins, methacrylic resins, polyvinyl acetate, and silicone resins; polyester resins having monomers selected from aliphatic polyhydric alcohols, aliphatic dicarboxylic acids, aromatic dicarboxylic acids, aromatic dialcohols and diphenols as structural units; polyurethane resins, polyamide resins, polyvinyl butyral, terpene resins, coumarone indene resins, petroleum resins, and hybrid resins having a polyester unit and a vinyl polymer unit.

For example, polyvinyl alcohol can be used as the binder.

In step 3, in the case of wet pulverizing, it is preferable to add a binder and, if necessary, a pore regulator by taking into consideration the water contained in the ferrite slurry.

The obtained ferrite slurry is dried and granulated using a spray drying device, preferably in a heating atmosphere at from 100° C. to 200° C. The spray drying device is not particularly limited as long as the desired particle diameter of the porous magnetic core particles can be obtained. For example, a spray dryer can be used.

Step 5 (Main Baking Step)

Next, the granulated product is baked, preferably at 800° C. to 1400° C., and preferably for 1 h to 24 h.

By raising the baking temperature and prolonging the baking time, baking of the porous magnetic core particles is promoted, and as a result, the pore diameter is decreased and the number of pores is also reduced.

Step 6 (Sorting Step)

After pulverizing the baked particles as described above, if necessary, coarse particles or fine particles may be removed by classification or screening with a sieve.

From the viewpoint of suppression of carrier adhesion and attachment to an image, the volume distribution standard 50% particle diameter (D50) of the magnetic core particles is preferably from 18.0 μm to 68.0 μm.

Step 7 (Filling Step)

Depending on the pore volume thereinside, the porous magnetic core particle may have a low physical strength, and in order to increase the physical strength as a magnetic carrier, at least a part of the voids of the porous magnetic core particle is preferably filled with a resin. The amount of the resin filled in the porous magnetic core particles is preferably 2% by mass to 15% by mass in the porous magnetic core particles.

Provided that the spread in the resin amount for each magnetic carrier is small, the resin may be filled in only a part of the internal voids, the resin may be filled only in the voids near the surface of the porous magnetic core particle while the voids remain inside, or the internal voids may be completely filled with the resin.

A method for filling the resin in the voids of the porous magnetic core particles is not particularly limited. For example, a method can be used by which a porous magnetic core particle is impregnated with a resin solution by a coating method such as an immersion method, a spray method, a brushing method and a fluidized bed, and the solvent is thereafter evaporated. Further, a method can also be used by which a resin is diluted with a solvent and then added to the voids in the porous magnetic core particle.

The solvent used here may be any one that can dissolve the resin. When the resin is soluble in an organic solvent, examples of the organic solvent include toluene, xylene, cellosolve butyl acetate, methyl ethyl ketone, methyl isobutyl ketone and methanol. In the case of a water-soluble resin or an emulsion-type resin, water may be used as the solvent.

The amount of solid resin fraction in the resin solution is preferably 1% by mass to 50% by mass, and more preferably 1% by mass to 30% by mass. When the amount is 50% by mass or less, the viscosity is not too high, and the resin solution easily penetrates uniformly into the voids of the porous magnetic core particles. Meanwhile, when the amount is 1% by mass or more, the amount of resin is appropriate, and the adhesion of the resin to the porous magnetic core particle is improved.

Either a thermoplastic resin or a thermosetting resin may be used as a resin for filling the voids of the porous magnetic core particles. A resin with high affinity to the porous magnetic core particle is preferable. When a resin having high affinity is used, the surface of the porous magnetic core particle can be covered with the resin simultaneously with the filling of the resin into the voids of the porous magnetic core particle.

Examples of the thermoplastic resin as the resin to be filled are as follows. A novolak resin, a saturated alkyl polyester resin, a polyarylate, a polyamide resin, an acrylic resin and the like.

Examples of the thermosetting resin are as follows. A phenol resin, an epoxy resin, an unsaturated polyester resin, a silicone resin and the like.

Further, the magnetic carrier has a resin coating layer on the surface of the magnetic carrier core.

A method for coating the surface of the magnetic carrier core with a resin is not particularly limited, and examples thereof include a coating method by an immersion method, a spray method, a brush coating method, a dry method, and a fluidized bed.

Further, conductive particles and particles and materials having charge controllability may be contained in the resin coating layer. Examples of conductive particles include carbon black, magnetite, graphite, zinc oxide and tin oxide.

The amount of conductive particles added is preferably 0.1 parts by mass to 10.0 parts by mass with respect to 100 parts by mass of the coating resin in order to adjust the resistance of the magnetic carrier.

Examples of particles having charge controllability include particles of organic metal complexes, particles of organic metal salts, particles of chelate compounds, particles of monoazo metal complexes, particles of acetylacetone metal complexes, particles of hydroxycarboxylic acid metal complexes, particles of polycarboxylic acid metal complexes, particles of polyol metal complexes, particles of polymethyl methacrylate resin, particles of polystyrene resin, particles of melamine resin, particles of phenol resin, particles of nylon resin, particles of silica, particles of titanium oxide, particles of alumina and the like.

The addition amount of the particles having charge controllability is preferably 0.5 parts by mass to 50.0 parts by mass with respect to 100 parts by mass of the coating resin in order to adjust the triboelectric charge quantity.

Next, the preferred toner configuration is described in detail below.

The toner has a toner particle including a binder resin and, as necessary, a colorant and a release agent. The binder resin may be exemplified by a vinyl resin, a polyester resin, an epoxy resin and the like. Among them, a vinyl resin and a polyester resin are more preferable in terms of charging performance and fixability. A polyester resin is particularly preferred.

Homopolymers or copolymers of vinyl monomers, polyesters, polyurethanes, epoxy resins, polyvinyl butyral, rosins, modified rosins, terpene resins, phenol resins, aliphatic or alicyclic hydrocarbon resins, aromatic petroleum resins, and the like can be used, if necessary, by mixing with the above-mentioned binder resin.

When two or more kinds of resins are mixed and used as a binder resin, in a more preferable embodiment, it is preferable that the resins having different molecular weights be mixed in a suitable proportion.

The glass transition temperature of the binder resin is preferably from 45° C. to 80° C., and more preferably from 55° C. to 70° C. The number average molecular weight (Mn) is preferably from 2,500 to 50,000. The weight average molecular weight (Mw) is preferably from 10,000 to 1,000,000.

The following polyester resins are also preferable as the binder resin.

It is preferable that from 45 mol % to 55 mol % be an alcohol component, and from 45 mol % to 55 mol % be an acid component, based on the total monomer units which constitute a polyester resin.

The acid value of the polyester resin is preferably from 0 mg KOH/g to 90 mg KOH/g, and more preferably from 5 mg KOH/g to 50 mg KOH/g. The hydroxyl value (OH value) of the polyester resin is preferably from 0 mg KOH/g to 50 mg KOH/g, and more preferably from 5 mg KOH/g to 30 mg KOH/g. This is because when the number of end groups of the molecular chain increases, the charging characteristics of the toner become more dependent on the environment.

The glass transition temperature of the polyester resin is preferably from 50° C. to 75° C., and more preferably from 55° C. to 65° C. The number average molecular weight (Mn) is preferably from 1500 to 50,000, and more preferably from 2000 to 20,000. The weight average molecular weight (Mw) is preferably from 6,000 to 100,000, and more preferably from 10,000 to 90000.

A crystalline polyester resin such as described below may be added to the toner for the purpose of promoting the plasticizing effect of the toner and improving the low-temperature fixability.

Examples of crystalline polyesters include polycondensates of monomer compositions including an aliphatic diol having from 2 to 22 carbon atoms and an aliphatic dicarboxylic acid having from 2 to 22 carbon atoms as the main components.

The aliphatic diol having from 2 to 22 carbon atoms (more preferably from 6 to 12 carbon atoms) is not particularly limited, but is preferably a chain (more preferably linear) aliphatic diol. Among these, particularly preferred are linear aliphatics such as ethylene glycol, diethylene glycol, 1,4-butanediol and 1,6-hexanediol, and also α, ω-diols.

Among the alcohol components, preferably 50% by mass or more, and more preferably 70% by mass or more is an alcohol selected from aliphatic diols having from 2 to 22 carbon atoms.

A polyhydric alcohol monomer other than aliphatic diols can also be used. Examples of the dihydric alcohol monomer include aromatic alcohols such as polyoxyethylenated bisphenol A, polyoxypropyleneated bisphenol A and the like; 1,4-cyclohexanedimethanol and the like.

Examples of trivalent or higher polyhydric alcohol monomers include aromatic alcohols such as 1,3,5-trihydroxymethylbenzene and the like; aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane and the like; and the like.

Furthermore, a monovalent alcohol may be used to such an extent that the properties of the crystalline polyester are not impaired.

Meanwhile, the aliphatic dicarboxylic acid having from 2 to 22 carbon atoms (more preferably from 6 to 12 carbon atoms) is not particularly limited, but is preferably a chain (more preferably linear) aliphatic dicarboxylic acid. Compounds obtained by hydrolyzing acid anhydrides or lower alkyl esters thereof are also included.

Among the carboxylic acid components, preferably 50% by mass or more, and more preferably 70% by mass or more is a carboxylic acid selected from aliphatic dicarboxylic acids having from 2 to 22 carbon atoms.

A polyvalent carboxylic acid other than the above-mentioned aliphatic dicarboxylic acids having from 2 to 22 carbon atoms can also be used. Examples of divalent carboxylic acids include aromatic carboxylic acids such as isophthalic acid, terephthalic acid and the like; aliphatic carboxylic acids such as n-dodecylsuccinic acid, n-dodecenylsuccinic acid and the like; and alicyclic carboxylic acids such as cyclohexanedicarboxylic acid and the like. Anhydrides or lower alkyl esters thereof are also included.

Examples of trivalent and higher polyvalent carboxylic acids include aromatic carboxylic acids such as 1,2,4-benzenetricarboxylic acid (trimellitic acid), 2,5,7-naphthalenetricarboxylic acid, 1,2,4-naphthalenetricarboxylic acid, pyromellitic acid and the like; and aliphatic carboxylic acids such as 1,2,4-butanetricarboxylic acid, 1,2,5-hexanetricarboxylic acid, 1,3-dicarboxyl-2-methyl-2-methylenecarboxypropane and the like. Derivatives and the like thereof such as anhydrides and lower alkyl esters are also included.

Furthermore, a monovalent monohydric carboxylic acid may be also included to such an extent that the characteristics of the crystalline polyester are not impaired.

The crystalline polyester can be produced according to a conventional polyester synthesis method. For example, after the esterification reaction or transesterification reaction of the abovementioned carboxylic acid monomer and alcohol monomer, a desired crystalline polyester is obtained by polycondensation reaction according to a conventional method under reduced pressure or by introducing nitrogen gas.

The amount of the crystalline polyester used is preferably from 0.1 parts by mass to 30 parts by mass, and more preferably from 0.5 parts by mass to 20 parts by mass with respect to 100 parts by mass of the binder resin. Preferably, this amount is from 3 parts by mass to 15 parts by mass.

The colorant is preferably nonmagnetic. Examples of the colorant are as follows.

Examples of the black colorant include carbon black and those adjusted to black using a yellow colorant, a magenta colorant and a cyan colorant.

Examples of color pigments for a magenta toner are as follows. Condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specific examples include C. I. Pigment Red 1, 2, 3, 4, 5, 6, 7, 8, 9, 10, 11, 12, 13, 14, 15, 16, 17, 18, 19, 21, 22, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, 269; C. I. Pigment Violet 19, and C. I. Vat Red 1, 2, 10, 13, 15, 23, 29, 35.

Although a pigment may be used alone as a colorant, it is preferable from the viewpoint of the image quality of a full color image to improve the definition by using a dye and a pigment in combination.

Examples of the magenta toner dye are as follows. Oil-soluble dyes such as C. I. Solvent Red 1, 3, 8, 23, 24, 25, 27, 30, 49, 81, 82, 83, 84, 100, 109, 121, C. I. Disperse Read 9, C. I. Solvent Violet 8, 13, 14, 21, 27, and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, 40, C. I. Basic Violet 1, 3, 7, 10, 14, 15, 21, 25, 26, 27, 28 and the like.

Examples of the color pigment for a cyan toner are as follows. C. I. Pigment Blue 1, 2, 3, 7, 15:2, 15:3, 15:4, 16, 17, 60, 62, 66; C. I. Vat Blue 6, C. I. Acid Blue 45, and copper phthalocyanine pigments in which from 1 to 5 phthalimidomethyl groups are substituted in the phthalocyanine skeleton.

Examples of color pigments for a yellow toner are as follows. Condensed azo compounds, isoindolinone compounds, anthraquinone compounds, azo metal compounds, methine compounds, allylamide compounds.

Specific examples include C. I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, 191; and C. I. Vat Yellow 1, 3, 20. Dyes such as C. I. Direct Green 6, C. I. Basic Green 4, C. I. Basic Green 6, Solvent Yellow 162 and the like can also be used.

The amount of the colorant used is preferably from 0.1 parts by mass to 30 parts by mass, more preferably from 0.5 parts by mass to 20 parts by mass, and further preferably from 3 parts by mass to 15 parts by mass with respect to 100 parts by mass of the binder resin.

A method for producing the toner is not particularly limited, and any known method can be used. For example, a melt-kneading method, a suspension polymerization method, a dissolution suspension method, an emulsion aggregation method and the like can be mentioned.

In the toner, it is preferable to use a binder resin in which a colorant is mixed in advance to make a master batch. Then, the colorant can be well dispersed in the toner by melt-kneading the colorant master batch and other raw materials (binder resin, wax and the like).

A charge control agent can be used, as necessary, to further stabilize the charging performance of the toner. The charge control agent is preferably used in an amount of 0.5 parts by mass to 10 parts by mass per 100 parts by mass of the binder resin. When the amount is 0.5 parts by mass or more, sufficient charging characteristics can be obtained. Meanwhile, when the amount is 10 parts by mass or less, the compatibility with other materials becomes satisfactory, and excessive charging under low humidity can be suppressed.

Examples of the charge control agent are as follows.

For example, an organic metal complex or a chelate compound is effective as a negative charging control agent which controls the toner to be negatively chargeable. Examples thereof include monoazo metal complexes, metal complexes of aromatic hydroxycarboxylic acids, and metal complexes of aromatic dicarboxylic acids. Other examples include aromatic hydroxycarboxylic acids, aromatic mono- and polycarboxylic acids and metal salts thereof, anhydrides thereof, or esters thereof, or phenol derivatives such as bisphenol.

Examples of positive charging control agents that control the toner to be positively chargeable include modified products of nigrosine and fatty acid metal salts, quaternary ammonium salts such as tributylbenzylammonium-1-hydroxy-4-naphthosulfonate, tetrabutylammonium tetrafluoroborate, and the like, onium salts such as phosphonium salts which are analogues thereof, and chelate pigments thereof, triphenylmethane dyes and lake pigments thereof (examples of lake forming agents include phosphotungstic acid, phosphomolybdic acid, phosphotungsten-molybdic acid, tannic acids, lauric acid, gallic acid, ferricyanic acid, ferrocyanide compounds and the like), and examples of metal salts of higher aliphatic acids include diorganotin oxides such as dibutyltin oxide, dioctyltin oxide, dicyclohexyltin oxide and the like, diorganotin borates such as dibutyltin borate, dioctyltin borate, dicyclohexyl tin borate and the like.

If necessary, one or two or more release agents may be contained in the toner particles. The following can be mentioned as a release agent.

Aliphatic hydrocarbon waxes such as low molecular weight polyethylene, low molecular weight polypropylene, microcrystalline wax and paraffin wax can be preferably used. Other examples include oxides of aliphatic hydrocarbon waxes, such as oxidized polyethylene wax, or block copolymers thereof; waxes mainly composed of fatty acid esters such as carnauba wax, sasol wax, montanic acid ester wax and the like; and partially or entirely deoxidized fatty acid esters such as deoxidized carnauba wax and the like.

The amount of the release agent is preferably from 0.1 parts by mass to 20 parts by mass, and more preferably from 0.5 parts by mass to 10 parts by mass with respect to 100 parts by mass of the binder resin.

Moreover, it is preferable that a melting point of a release agent defined by a maximum endothermic peak temperature at the time of temperature rise measured with a differential scanning calorimeter (DSC) be from 65° C. to 130° C., and more preferably from 80° C. to 125° C. When the melting point is 65° C. or more, the viscosity of the toner is suitable, so that the toner adhesion to the photosensitive member can be suppressed. Meanwhile, when the melting point is 130° C., the low-temperature fixability is improved.

Fine powder that, when externally added to the toner particles, can increase the flowability as compared with that before the addition can be used as a flowability improver of the toner. Examples of suitable fine powders include fluororesin powder such as fine powder of vinylidene fluoride and fine powder of polytetrafluoroethylene; and finely powdered silica such as wet method silica and dry method silica, finely powdered titanium oxide, finely powdered alumina, and the like, subjected to surface treatment and hydrophobized with a silane coupling agent, a titanium coupling agent or silicone oil, and those treated so that the degree of hydrophobization measured by a methanol titration test exhibits a value in the range of from 30 to 80 are particularly preferable.

The inorganic fine particles are preferably used in an amount of from 0.1 parts by mass to 10 parts by mass, and more preferably from 0.2 parts by mass to 8 parts by mass with respect to 100 parts by mass of toner particles.

The two-component developer of the present invention includes a toner having a toner particle including a binder resin, and a magnetic carrier.

When the toner is mixed with the magnetic carrier, the carrier mixing ratio at that time is preferably from 2% by mass to 15% by mass, and more preferably from 4% by mass to 13% by mass, as the toner concentration in the developer, and satisfactory results are usually obtained in these ranges. When the toner concentration is 2% by mass or more, the image density is satisfactory, and when the toner concentration is 15% by mass or less, fogging and scattering inside the machine can be suppressed.

The two-component developer including the magnetic carrier of the present invention can be used in an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material.

The image forming method may have a configuration such that the two-component developer is contained in a developing device, and a replenishing developer is supplied to the developing device according to the reduction of the toner concentration of the two-component developer in the developing device. The magnetic carrier of the present invention can be used in the replenishing developer for use in such an image forming method. The image forming method may also have a configuration in which excess magnetic carrier in the developing device is discharged from the developing device as needed.

The replenishing developer preferably includes a magnetic carrier, and a toner having a toner particle including a binder resin and, if necessary, a colorant and a release agent. The replenishing developer preferably includes from 2 parts by mass to 50 parts by mass of the toner with respect to 1 part by mass of the replenishing magnetic carrier. The replenishing developer may be only the toner, without having the replenishing magnetic carrier.

Next, an image forming apparatus provided with a developing device using a magnetic carrier, a two-component developer and a replenishing developer will be described by way of example, but the present invention is not limited thereto.

Image Forming Method

In FIG. 1, an electrostatic latent image bearing member 1 rotates in the direction of the arrow in the figure. The electrostatic latent image bearing member 1 is charged by a charger 2, which is a charging unit, and the surface of the charged electrostatic latent image bearing member 1 is exposed by an exposure unit 3, which is an electrostatic latent image forming unit, to form an electrostatic latent image. The developing device 4 has a developing container 5 for containing a two-component developer, the developer carrying member 6 is rotatably disposed, and magnets 7 are enclosed as a magnetic field generating means inside the developer carrying member 6. At least one of the magnets 7 is installed so as to face the latent image bearing member.

The two-component developer is held on the developer carrying member 6 by the magnetic field of the magnet 7, the amount of the two-component developer is regulated by a regulating member 8, and the two-component developer is transported to a developing unit facing the electrostatic latent image bearing member 1. In the developing unit, a magnetic brush is formed by the magnetic field generated by the magnet 7. Thereafter, the electrostatic latent image is visualized as a toner image by applying a developing bias in which an alternating electric field is superimposed on a DC electric field. The toner image formed on the electrostatic latent image bearing member 1 is electrostatically transferred to a recording medium 12 by a transfer charger 11.

Figure 2:
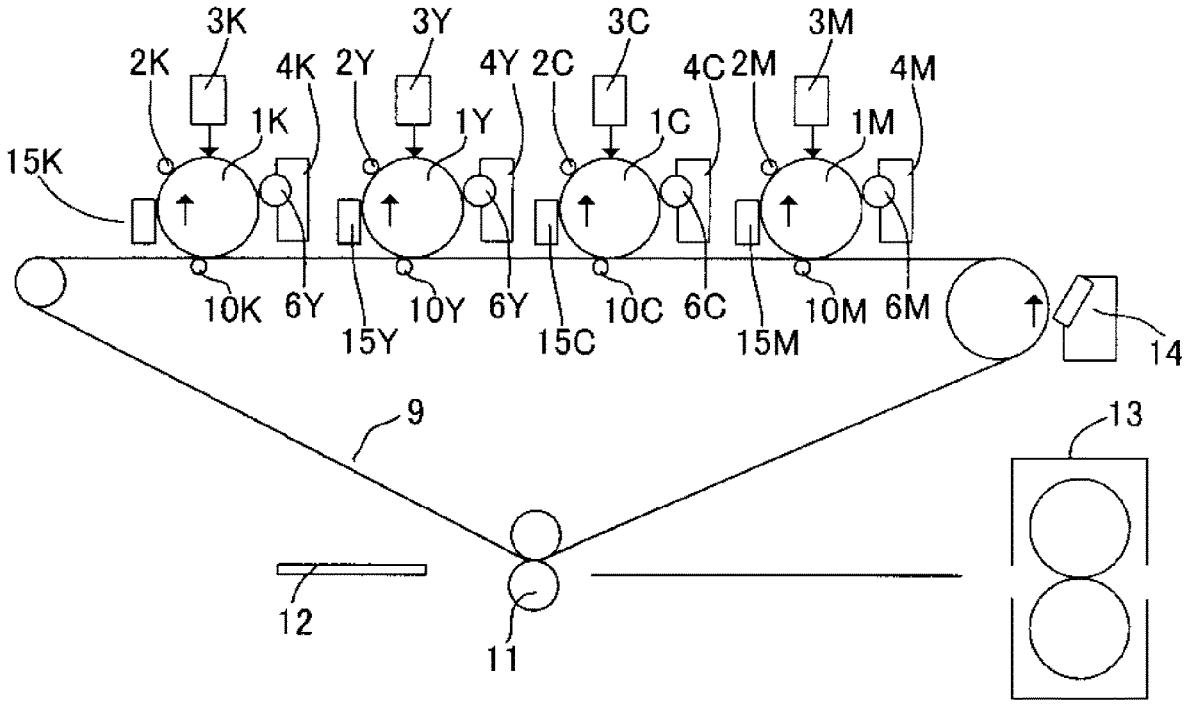
FIG. 2 is a schematic view of an image forming apparatus.

Here, as shown in FIG. 2, the latent image may be temporarily transferred from the electrostatic latent image bearing member 1 to an intermediate transfer member 9 and then electrostatically transferred to a transfer material (recording medium) 12. Thereafter, the recording medium 12 is transported to a fixing device 13, where the toner is fixed on the recording medium 12 by being heated and pressed. Thereafter, the recording medium 12 is discharged as an output image out of the apparatus. After the transfer step, the toner remaining on the electrostatic latent image bearing member 1 is removed by a cleaner 15.

Thereafter, the electrostatic latent image bearing member 1 cleaned by the cleaner 15 is electrically initialized by light irradiation from a pre-exposure 16, and the image forming operation is repeated.

FIG. 2 shows an example of a full color image forming apparatus.

The arrows indicating the arrangement of the image forming units such as K, Y, C, M, and the like and the rotation direction in the figure are not limited to those shown in the figure. Here, K means black, Y means yellow, C means cyan, and M means magenta. In FIG. 2, electrostatic latent image bearing members 1K, 1Y, 1C, 1M rotate in the direction of the arrow in the figure. Each electrostatic latent image bearing member is charged by charging units 2K, 2Y, 2C, 2M as charging means, and on the surface of each electrostatic latent image bearing member that has been charged, exposure is performed with exposure units 3K, 3Y, 3C, 3M as electrostatic latent image forming means to form an electrostatic latent image.

After that, the electrostatic latent image is visualized as a toner image by the two-component developers carried on the developer carrying members 6K, 6Y, 6C, 6M provided in the developing units 4K, 4Y, 4C, 4M, which are developing means. Further, the toner image is transferred to the intermediate transfer member 9 by intermediate transfer chargers 10K, 10Y, 10C, 10M which are transfer means. Further, the image is transferred to the recording medium 12 by the transfer charger 11, which is a transfer means, and the recording medium 12 is outputted as an image after heating and pressurizing with the fixing device 13 which is a fixing means. Then, the intermediate transfer member cleaner 14, which is a cleaning member of the intermediate transfer member 9, recovers the transfer residual toner and the like.

As a developing method, specifically, it is preferable to perform development in a state in which the magnetic brush is in contact with the photosensitive member while applying an alternating voltage to the developer carrying member to form an alternating electric field in the development region. The distance (S-D distance) between the developer carrying member (developing sleeve) 6 and a photosensitive drum of from 100 μm to 1000 μm is satisfactory in preventing carrier adhesion and improving dot reproducibility. Where the distance is 100 μm or more, the supply of the developer is sufficient and the image density is satisfactory. When the distance is 1000 μm or less, magnetic lines from the magnetic pole S1 are unlikely to spread, the density of the magnetic brush becomes satisfactory, and dot reproducibility is improved. In addition, a force restraining the magnetic coat carrier is increased, and the carrier adhesion can be suppressed.

The voltage (Vpp) between the peaks of the alternating electric field is preferably from 300 V to 3000 V, and more preferably from 500 V to 1800 V. The frequency is preferably from 500 Hz to 10,000 Hz, and more preferably from 1000 Hz to 7000 Hz, and can be appropriately selected and used according to the process.

In this case, the waveform of the AC bias for forming the alternating electric field can be exemplified by a triangular wave, a rectangular wave, a sine wave, and a waveform in which the Duty ratio is changed. At the same time, in order to cope with changes in the formation speed of toner images, it is preferable to perform development by applying a developing bias voltage (intermittent alternating superimposed voltage) having a discontinuous AC bias voltage to the developer carrying member. When the applied voltage is 300 V or more, sufficient image density can be easily obtained, and the fog toner in the non-image area can be easily recovered. When the voltage is 3000 V or less, disturbance of the latent image through the magnetic brush is unlikely to occur, and a satisfactory image quality can be obtained.

By using a two-component developer having a toner that has been satisfactorily charged, it is possible to lower the fog removal voltage (Vback) and reduce the primary charge of the photosensitive member, thereby prolonging the life of the photosensitive member. Vback depends on the development system, but is preferably 200 V or less, and more preferably 150 V or less. A potential from 100 V to 400 V is preferably used as a contrast potential so that sufficient image density could be obtained.

Where the frequency is lower than 500 Hz, the electrostatic latent image-bearing member may have the same configuration as the photosensitive member usually used in image forming apparatuses, although the specific configuration is correlated with the process speed. For example, the photosensitive member can be configured by providing a conductive layer, an undercoat layer, a charge generation layer, a charge transport layer, and, if necessary, a charge injection layer in the order of description on a conductive substrate such as aluminum or SUS.

The conductive layer, the undercoat layer, the charge generation layer, and the charge transport layer may be those generally used for a photosensitive member. For example, a charge injection layer or a protective layer may be used as the outermost surface layer of the photosensitive member.

Hereafter, methods for measuring the physical properties relating to the present invention are described.

Figure 3A:
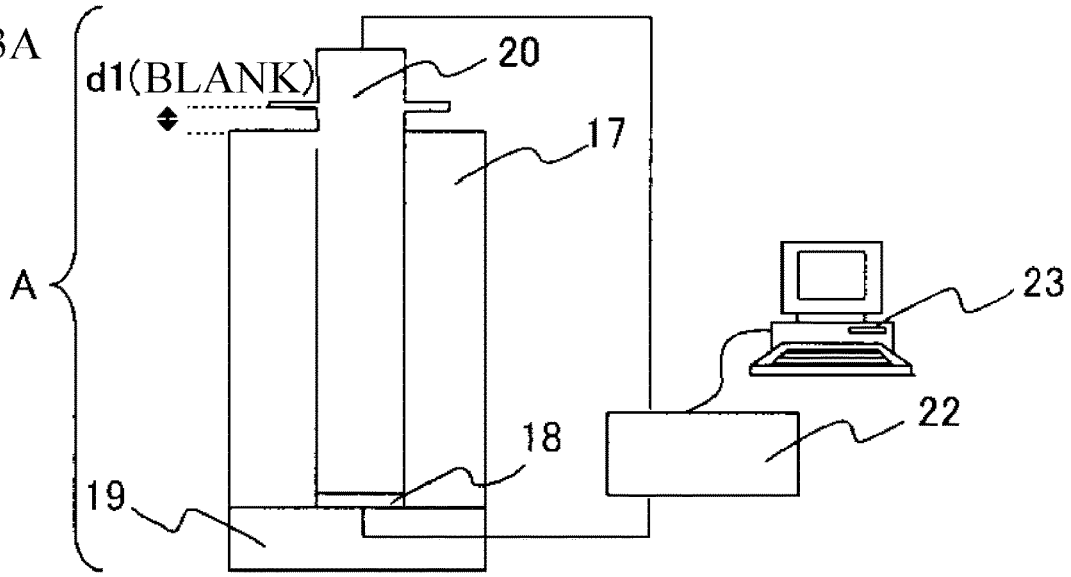
FIGS. 3A and 3B are schematic views of a device for measuring the resistivity of a magnetic carrier.
Figure 3B:
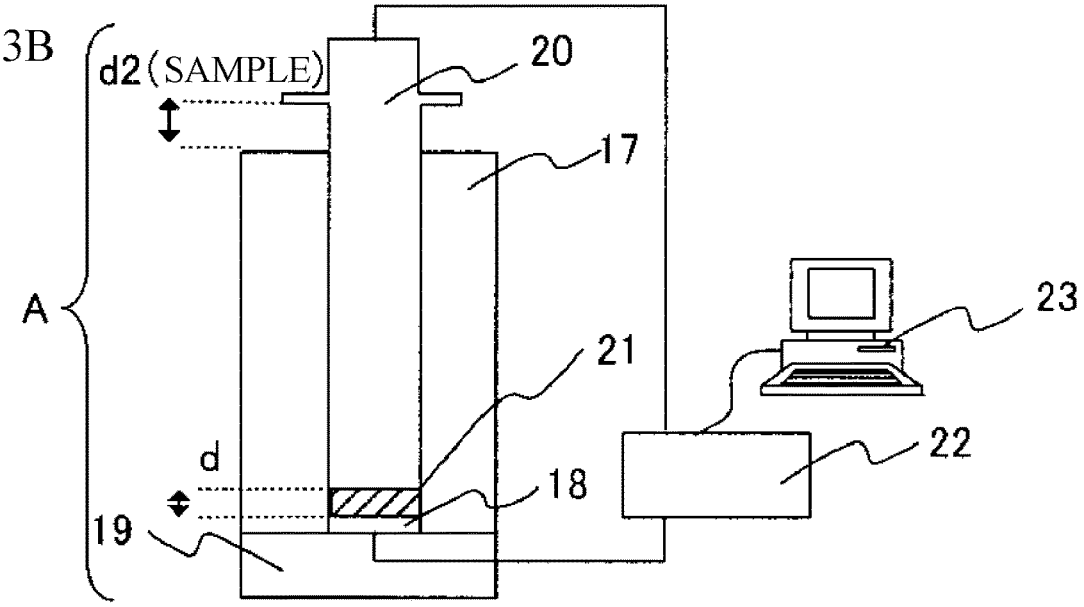

Measurement of Specific Resistance of Magnetic Carrier, Porous Magnetic Core, and Magnetic Core The specific resistance of the magnetic carrier, porous magnetic core, and magnetic core is measured using the measuring device outlined in FIGS. 3A and 3B. The specific resistance of the magnetic carrier is measured at the electric field strength of 2000 (V/cm), and specific resistance of the porous magnetic core is measured at the electric field strength of 300 (V/cm).

The resistance measuring cell A is configured of a cylindrical container (made of PTFE resin) 17 with a hole having a cross-sectional area of 2.4 $cm^2$, a lower electrode (made of stainless steel) 18, a support pedestal (made of PTFE resin) 19, and an upper electrode (made of stainless steel) 20. The cylindrical container 18 is placed on the support pedestal 19, a sample (magnetic carrier or carrier core) 21 is filled to a thickness of about 1 mm, the upper electrode 20 is placed on the filled sample 21, and the thickness of the sample is measured. Where the gap when there is no sample is denoted by d1, as shown in FIG. 3A, and the gap when the sample is filled to be about 1 mm thick, as shown in FIG. 3B, is denoted by d2, the thickness d of the sample is calculated by the following equation:

$$d=d2-d1 \text{ (mm)}.$$

At this time, the mass of the sample is appropriately changed so that the thickness d of the sample becomes from 0.95 mm to 1.04 mm.

The specific resistance of the sample can be determined by applying a DC voltage between the electrodes and measuring the current flowing at that time. An electrometer 22 (Keithley 6517A, manufactured by Keithley Instruments Co., Ltd.) and a processing computer 23 are used for measurement and control, respectively.

A control system manufactured by National Instruments Corporation and control software (LabVEIW, manufactured by National Instruments Corporation) are used as a control processing computer.

As measurement conditions, a contact area S between the sample and the electrode=2.4 $cm^2$ and a value d measured so that the thickness of the sample is from 0.95 mm to 1.04 mm are inputted. Further, the load on the upper electrode is 270 g, and the maximum applied voltage is 1000 V.

Specific resistance (Ω·cm)=(applied voltage (V)/measurement current (A))×S ($cm^2$)/d (cm) electric field strength (V/cm)=applied voltage (V)/d (cm)

The specific resistance of the magnetic carrier, porous magnetic core, and magnetic core at the aforementioned electric field strength is obtained by reading the specific resistance at the electric field strength on the graph from the graph.

Method for Measuring Volume Average Particle Diameter (D50) of Magnetic Carrier and Porous Magnetic Core The particle size distribution is measured by a laser diffraction/scattering type particle size distribution measuring apparatus "MICROTRAC MT3300EX" (manufactured by Nikkiso Co., Ltd.).

The measurement of the volume average particle diameter (D50) of the magnetic carrier and porous magnetic core is carried out by attaching a sample feeder for dry measurement "One-shot dry type sample conditioner Turbotrac" (manufactured by Nikkiso Co., Ltd.). The supply conditions of Turbotrac are as follows: a dust collector is used as a vacuum source, the air volume is about 33 L/sec, and the pressure is about 17 kPa. Control is performed automatically on software. As the particle diameter, a 50% particle diameter (D50), which is a cumulative value of volume average, is determined. Control and analysis are performed using provided software (version 10.3.3-202D). The measurement conditions are as follows.

SetZero time: 10 sec
Measurement time: 10 sec
Number of measurements: 1 cycle
Particle refractive index: 1.81%
Particle shape: non-spherical
Upper limit of measurement: 1408
Lower limit of measurement: 0.243
Measurement environment: 23° C., 50% RH Measurement of Pore Size and Pore Volume of Porous Magnetic Core The pore size distribution of the porous magnetic core is measured by mercury porosimetry.

The measurement principle is as follows.

In this measurement, the pressure applied to mercury is changed, and the amount of mercury penetrated into the pores at that time is measured. The condition under which mercury can penetrate into the pores can be expressed as $PD=-4\sigma\cos\theta$ from the balance of forces, where P is the pressure, D is the pore diameter, and θ and σ are the contact angle and surface tension of mercury, respectively. Assuming that the contact angle and the surface tension are constants, the pressure P and the pore diameter D to which mercury can penetrate at that time are inversely proportional. Therefore, the pressure on the abscissa of a P-V curve obtained by measuring the pressure P and the amount V of the penetrating liquid at that time by changing the pressure is directly converted from this equation into the pore diameter to obtain the pore distribution.

Measurement can be performed using a fully automatic multifunction mercury porosimeter PoreMaster series/PoreMaster-GT series manufactured by Yuasa-Ionics Co., an automatic porosimeter AUTOPORE IV 9500 series manufactured by Shimadzu Corporation, or the like as a measuring apparatus.

Specifically, measurement is performed under the following conditions and according to the following procedure by using AUTOPORE IV 9520 manufactured by Shimadzu Corporation.

Measurement Conditions

Measurement environment: 20° C.

Measurement cell: sample volume 5 $cm^3$, press-fit volume 1.1 $cm^3$, application: for powder Measurement range: from 2.0 psia (13.8 kPa) to 59989.6 psia (413.7 kPa)

Measurement step: 80 steps (When taking the pore diameter in logarithm, the steps are set so as to be equally spaced)

Press-fit Parameter

Exhaust pressure: 50 μm Hg
Exhaust time: 5.0 min
Mercury injection pressure: 2.0 psia (13.8 kPa)
Equilibrium time: 5 secs High-pressure Parameter Equilibrium time: 5 secs Mercury Parameter Advance contact angle: 130.0 degrees
Retracting contact angle: 130.0 degrees
Surface tension: 485.0 mN/m (485.0 dynes/cm)
Mercury density: 13.5335 g/mL Measurement Procedure (1) About 1.0 g of the porous magnetic core is weighed and put it the sample cell. The weighing value is inputted (2) The range of from 2.0 psia (13.8 kPa) to 45.8 psia (315.6 kPa) is measured at the low-pressure part.

(3) The range of from 45.9 psia (316.3 kPa) to 59989.6 psia (413.6 kPa) is measured at the high-pressure part.

(4) The pore size distribution is calculated from the mercury injection pressure and the mercury injection amount.

The steps (2), (3), and (4) are automatically performed by software provided with the device.

From the pore diameter distribution measured as described above, the pore diameter at which the differential pore volume in the range of the pore diameter of from 0.1 μm to 3.0 μm is maximized is read and used to set the pore diameter at which the differential pore volume becomes maximal.

Further, the pore volume obtained by integrating the differential pore volume in the range of the pore diameter of from 0.1 μm to 3.0 μm is calculated using the provided software and set as a pore volume.

Separation of Resin Coating Layer from Magnetic Carrier and Fractionation of Resins A and B in Resin Coating Layer A method in which a magnetic carrier is taken in a cup, a coating resin is eluted using toluene, and the eluted resin is dried up can be used as a method for separating the resin coating layer from the magnetic carrier and recovering the resin component contained in the resin coating layer.

Fractionation of resins A and B is carried out using the following apparatus after drying the eluted resin and then dissolving in tetrahydrofuran (THF).

Device Configuration

LC-908 (manufactured by Japan Analytical Industry Co., Ltd.)

JRS-86 (same company; repeat injector)

JAR-2 (same company; auto sampler)

FC-201 (Gilson Co.; Fraction Collector)

Column Configuration

JAIGEL-1H to 5H (20 ϕ×600 mm: fractionation column) (manufactured by Japan Analytical Industry Co., Ltd.)

Measurement Conditions

Temperature: 40° C.

Solvent: THF

Flow rate: 5 ml/min.

Detector: RI

Based on the molecular weight distribution of the resin component contained in the coating resin, the elution time to obtain the peak molecular weight (Mp) of the resin A and the resin B is measured in advance using the resin configuration specified by the following method, and the respective resin components are fractionated therebefore and thereafter. Then, the solvent is removed and drying is performed to obtain the resin A and the resin B.

An atomic group can be specified from an absorption wave number using a Fourier-transform infrared spectroscopic analysis apparatus (Spectrum One: manufactured by PerkinElmer Inc.), and the resin composition of the resin A and the resin B can be specified.

Measurement of Molecular Weight Distribution of Resin Component Contained in Resin Coating Layer The resin component contained in the coating resin layer separated from the magnetic carrier by the above-described method and tetrahydrofuran (THF) are mixed at a concentration of 5 mg/ml and allowed to stand at room temperature for 24 h to dissolve the sample in THF. The solution that was thereafter passed through a sample-treated filter (Mishori Disc H-25-2 manufactured by Tosoh Corporation) is taken as a GPC sample.

Next, using a GPC measurement apparatus (HLC-8120GPC manufactured by Tosoh Corporation), measurement is performed under the following measurement conditions according to the operation manual of the apparatus.

Measurement Conditions

Device: high-speed GPC "HLC 8120 GPC" (manufactured by Tosoh Corporation)

Columns: 7 series of Shodex KF-801, 802, 803, 804, 805, 806, 807 (manufactured by Showa Denko K.K.)

Eluent: THF

Flow rate: 1.0 ml/min

Oven temperature: 40.0° C.

Sample injection volume: 0.10 ml

Further, in calculating the weight average molecular weight (Mw) and peak molecular weight (Mp) of the sample, a molecular weight calibration curve generated by standard polystyrene resins (TSK standard polystyrene F-850, F-450, F-288, F-128, F-80, F-40, F-20, F-10, F-4, F-2, F-1, A-5000, A-2500, A-1000, A-500; manufactured by Tosoh Corporation) is used as the calibration curve.

A resin from which the respective peak is derived in the obtained molecular weight distribution is confirmed by performing fractionation according to the above-described fractionation method of the resin A and the resin B. The molecular weight in the peak top of the peak derived from each resin is a peak molecular weight.

Figure 5:
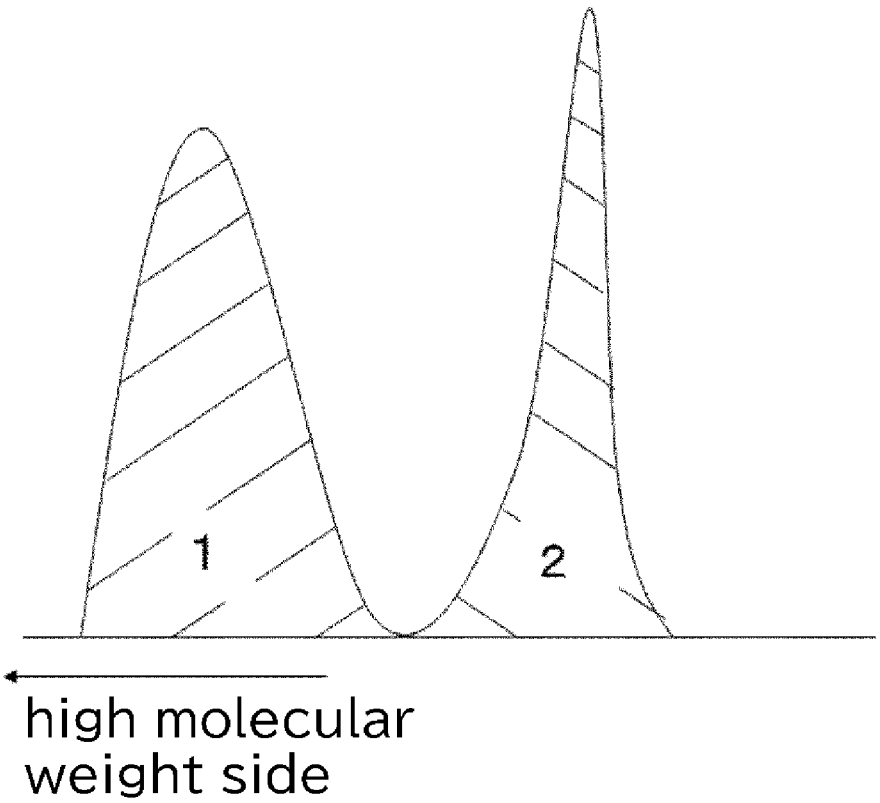
FIG. 5 is a schematic view of a method for specifying the amount of coating resin in a GPC molecular weight distribution curve.
Figure 6:
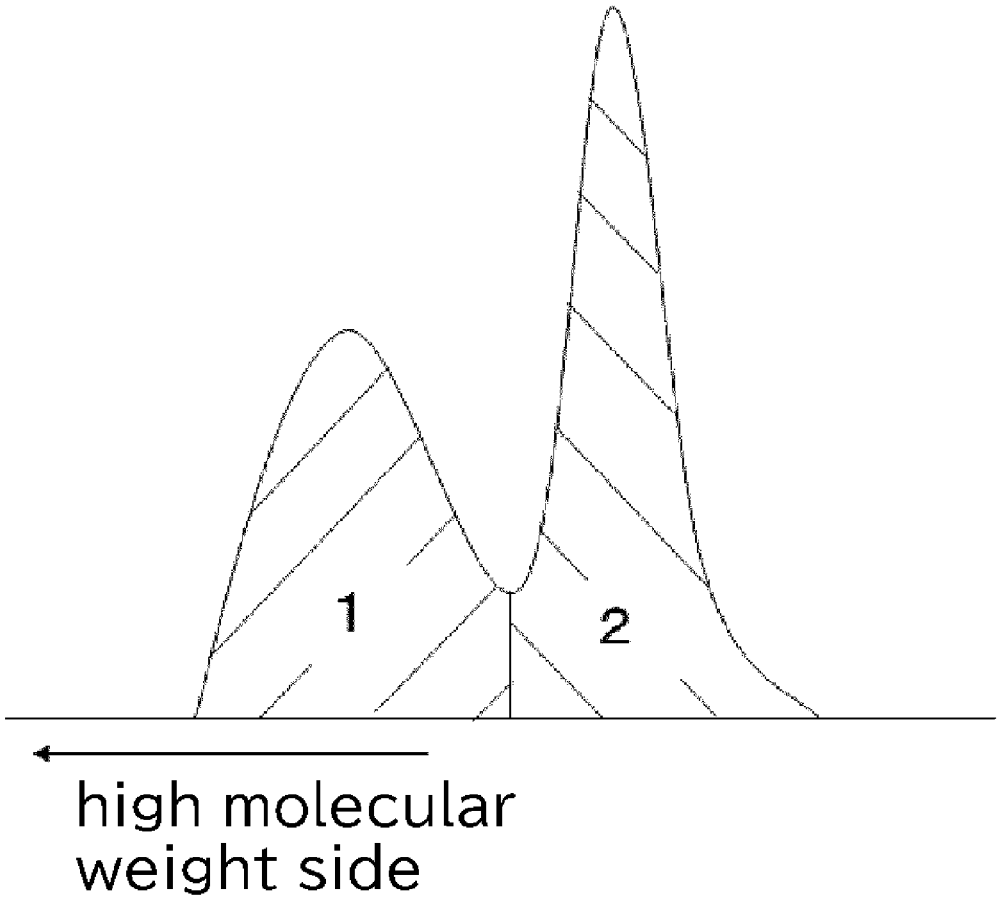
FIG. 6 is a schematic view of a method for specifying the amount of coating resin in a GPC molecular weight distribution curve.

Further, the content ratio is obtained from a peak area ratio in molecular weight distribution measurement. As shown in FIG. 5, when a region 1 and a region 2 are completely separated, the resin content ratio is determined from the area ratio of respective regions. As shown in FIG. 6, in the case where the respective regions overlap, division is made by a line dropped to the horizontal axis vertically from the inflection point of the GPC molecular weight distribution curve, and the content ratio is obtained from the area ratio of the region 1 and the region 2 shown in FIG. 6.

Measurement of Weight Average Molecular Weight (Mw) of Resin A and Resin B

The measurement of the molecular weight is carried out in the same manner as in the "Measurement of Molecular Weight Distribution of Resin Component Contained in Resin Coating Layer" except that the components fractionated according to the method for fractionating the resin A and the resin B are used as the measurement samples, and the weight average molecular weight (Mw) is calculated based on the obtained molecular weight distribution.

Measurement of Current Value

Figure 4:
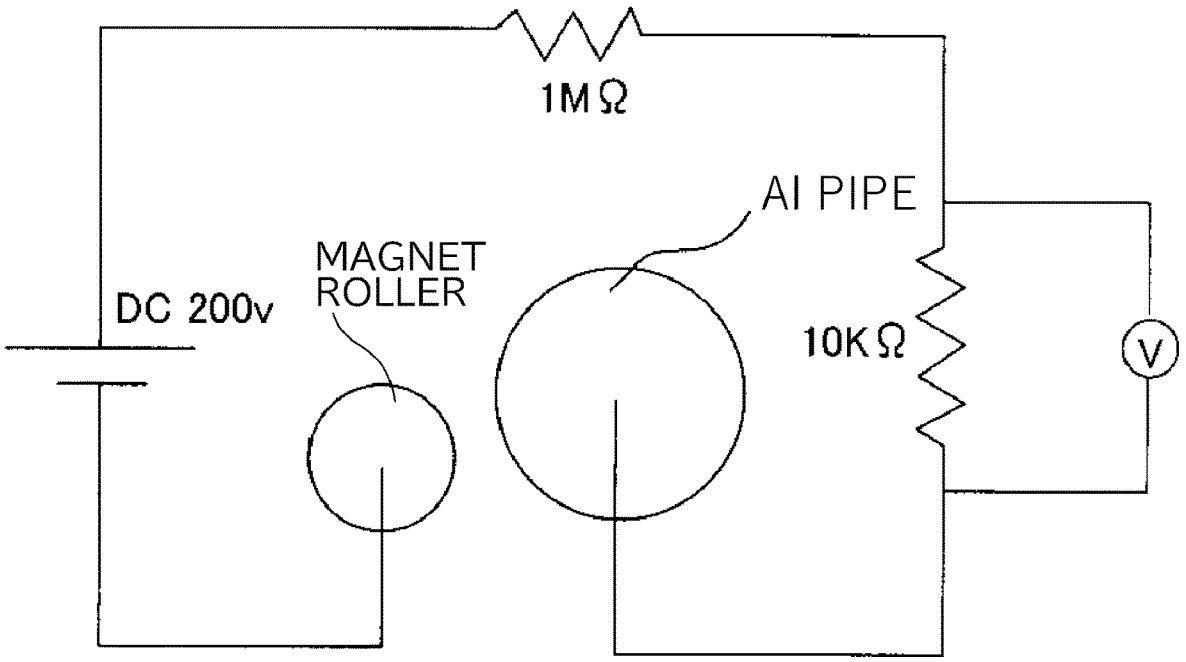
FIG. 4 is a schematic view of a device for measuring the current value of a magnetic carrier.

A total of 800 g of the magnetic carrier was weighed and exposed to an environment of a temperature of from 20° C. to 26° C. and a humidity of from 50% RH to 60% RH for 15 min or more. After that, measurement was performed at an applied voltage of 500 V using a current value measuring device in which a magnet roller and an A1 tube shown in FIG. 4 were used as electrodes and the distance therebetween was set to 4.5 mm.

Method for Measuring Weight Average Particle Diameter (D4) and Number Average Particle Diameter (D1)

The weight average particle diameter (D4) and number average particle diameter (D1) of the toner were determined using a precision particle size distribution measuring apparatus (registered trademark, "Coulter Counter Multisizer 3", manufactured by Beckman Coulter, Inc.) based on a pore electric resistance method and equipped with an aperture tube having a diameter of 100 μm and dedicated software "Beckman Coulter Multisizer 3 Version 3.51" (manufactured by Beckman Coulter, Inc.) which is provided with the apparatus and used to set the measurement conditions and analyze the measurement data. The measurement was performed with 25,000 effective measurement channels, and the measurement data were analyzed and calculated.

A solution prepared by dissolving special grade sodium chloride in ion exchanged water to a concentration of about 1% by mass, for example, "ISOTON II" (trade name) manufactured by Beckman Coulter, Inc., can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using "standard particles 10.0 μm" (manufactured by Beckman Coulter, Inc.) is set as a Kd value. The threshold and the noise level are automatically set by pressing a measurement button of threshold/noise level. Further, the current is set to 1600 μA, the gain is set to 2, the electrolytic solution is set to ISOTON II (trade name), and flush of aperture tube after measurement is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE TUBE" function of the dedicated software.

(2) A total of 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(3) A predetermined amount of ion exchanged water is placed in the water tank of an ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 2 mL of the CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) and the number average particle diameter (D1) are calculated. The "AVERAGE DIAMETER" on the analysis/volume statistical value (arithmetic mean) screen when the dedicated software is set to graph/volume % is the weight average particle diameter (D4). The "AVERAGE DIAMETER" on the analysis/number statistical value (arithmetic mean) screen when the dedicated software is set to graph/number % is the number average particle diameter (D1).

Method for Calculating Fine Powder Amount

The fine powder amount (number %) based on the number of particles in the toner is calculated as follows.

For example, after measuring the number % of particles equal to or less than 4.0 μm in the toner with the Multisizer 3, (1) the dedicated software is set to graph/number % and the chart of the measurement results is displayed as number %. (2) In the particle diameter setting portion on the form/particle diameter/particle diameter statistics screen, "<" is checked, and "4" is inputted to the particle diameter input portion therebelow. Then, (3) the numerical value on the "≤4 μm" display part when the analysis/number statistical value (arithmetic mean) screen is displayed is the number % of particles equal to or less than 4.0 μm in the toner.

Method for Calculating Coarse Powder Amount

The coarse powder amount (volume %) based on the volume in the toner is calculated as follows.

For example, after measuring the volume % of particles equal to or greater than 10.0 μm in the toner with the Multisizer 3, (1) the dedicated software is set to graph/volume % and the chart of the measurement results is displayed as volume %. (2) In the particle diameter setting portion on the form/particle diameter/particle diameter statistics screen, ">" is checked, and "10" is inputted to the particle diameter input portion therebelow. Then, (3) the numerical value on the ">10 μm" display part when the analysis/volume statistical value (arithmetic mean) screen is displayed is the volume % of particles equal to or greater than 10.0 μm in the toner.

EXAMPLES

Hereinafter, the present invention will be more specifically described with reference to examples, but the present invention is not limited to these examples. In the following formulations, parts are by mass unless otherwise specified.

Production Example of Resin A-1

The raw materials listed in Table 1 (total 109.0 parts) were added to a four-neck flask provided with a reflux condenser, a thermometer, a nitrogen suction pipe and an agitation type stirring device, then 100.0 parts of toluene, 100.0 parts of methyl ethyl ketone, and 2.4 parts of azobisisovaleronitrile were added, and the flask was kept at 80° C. for 10 h under nitrogen flow to obtain the solution of a resin A-1 (solid content: 35% by mass).

Resins A-2 to A-17 were obtained in the same manner by using the raw materials listed in Table 1. Physical properties are shown in Table 1.

Production Example of Resin B-1

An autoclave was charged with 50 parts of xylene, purged with nitrogen, and then heated to 185° C. in a sealed state under stirring. A mixed solution of 100 parts of the raw materials listed in Table 2, 50 parts of di-t-butyl peroxide, and 20 parts of xylene was continuously added dropwise for 3 h, while controlling the temperature inside the autoclave at 185° C., to conduct polymerization. The polymerization was completed by further maintaining the temperature for 1 h, and the solvent was removed to obtain a resin B-1.

Resins B-2 to B-12 were obtained in the same manner by using the raw materials listed in Table 2. Physical properties are shown in Table 2.

TABLE 1

| Formulations of coating resin A | | | | | | |
|---|---|---|---|---|---|---|
| | Main chain monomer | | Macromonomer | | | |
| Resin A | Constituting monomers | Amount added % by mass | Constituting monomers | Mw ($\times 10^3$) | Amount added % by mass | Mw ($\times 10^4$) |
| A-1 | Cyclohexyl methacrylate | 69.5 | Methyl methacrylate | 5.0 | 30.0 | 4.0 |
| | Methyl methacrylate | 0.5 | | | | |
| A-2 | Cyclohexyl methacrylate | 74.5 | Methyl methacrylate | 5.0 | 25.0 | 6.0 |
| | Methyl methacrylate | 0.5 | | | | |
| A-3 | Cyclohexyl methacrylate | 64.5 | Methyl methacrylate | 5.0 | 35.0 | 3.0 |
| | Methyl methacrylate | 0.5 | | | | |
| A-4 | Cyclohexyl methacrylate | 74.5 | Methyl methacrylate | 7.0 | 25.0 | 4.0 |
| | Methyl methacrylate | 0.5 | | | | |
| A-5 | Cyclohexyl methacrylate | 64.5 | Methyl methacrylate | 3.0 | 35.0 | 4.0 |
| | Methyl methacrylate | 0.5 | | | | |
| A-6 | Cyclohexyl methacrylate | 79.5 | Methyl methacrylate | 5.0 | 20.0 | 4.0 |
| | Methyl methacrylate | 0.5 | | | | |
| A-7 | Cyclohexyl methacrylate | 64.5 | Methyl methacrylate | 5.0 | 35.0 | 4.0 |
| | Methyl methacrylate | 0.5 | | | | |
| A-8 | Cyclohexyl methacrylate | 59.5 | Methyl methacrylate | 5.0 | 40.0 | 4.0 |
| | Methyl methacrylate | 0.5 | | | | |
| A-9 | Cyclohexyl methacrylate | 84.5 | Methyl methacrylate | 9.5 | 15.0 | 4.0 |
| | Methyl methacrylate | 0.5 | | | | |
| A-10 | Cyclohexyl methacrylate | 89.5 | Methyl methacrylate | 1.0 | 10.0 | 4.0 |
| | Methyl methacrylate | 0.5 | | | | |
| A-11 | Cyclohexyl methacrylate | 89.5 | Methyl methacrylate | 9.5 | 10.0 | 4.0 |
| | Methyl methacrylate | 0.5 | | | | |
| A-12 | Cyclohexyl methacrylate | 89.5 | Methyl methacrylate | 9.5 | 10.0 | 7.2 |
| | Methyl methacrylate | 0.5 | | | | |
| A-13 | Cyclohexyl methacrylate | 89.5 | Methyl methacrylate | 9.5 | 10.0 | 2.6 |
| | Methyl methacrylate | 0.5 | | | | |
| A-14 | Cyclohexyl methacrylate | 89.5 | Methyl methacrylate | 0.5 | 10.0 | 2.1 |
| | Methyl methacrylate | 0.5 | | | | |
| A-15 | Cyclohexyl methacrylate | 89.5 | Methyl methacrylate | 10.0 | 10.0 | 7.8 |
| | Methyl methacrylate | 0.5 | | | | |
| A-16 | Cyclohexyl methacrylate | 99.5 | — | — | — | 7.8 |
| | Methyl methacrylate | 0.5 | | | | |
| A-17 | — | — | Methyl methacrylate | 10.0 | 100.0 | 7.8 |

In the table, the macromonomers have methacryloyl group at the terminal thereof as a reactive C—C double bond.

TABLE 2

| Formulations of coating resin B | | | |
|---|---|---|---|
| | Monomers | | Weight average |
| | Constituting monomers | Amount added % by mass | molecular weight (Mw × $10^3$) |
| Resin B-1 | Styrene | 99.9900 | 3.0 |
| | Butyl acrylate | 0.0100 | |
| Resin B-2 | Styrene | 99.9990 | 2.0 |
| | Butyl acrylate | 0.0010 | |
| Resin B-3 | Styrene | 99.5000 | 4.0 |
| | Butyl acrylate | 0.5000 | |
| Resin B-4 | Styrene | 99.4000 | 1.5 |
| | Butyl acrylate | 0.6000 | |
| Resin B-5 | Styrene | 99.9995 | 9.0 |
| | Butyl acrylate | 0.0005 | |
| Resin B-6 | Styrene | 99.9995 | 1.5 |
| | Butyl acrylate | 0.0005 | |
| Resin B-7 | Styrene | 99.9995 | 1.1 |
| | Butyl acrylate | 0.0005 | |
| Resin B-8 | Styrene | 99.9995 | 9.7 |
| | Butyl acrylate | 0.0005 | |
| Resin B-9 | Styrene | 99.9995 | 0.5 |
| | Butyl acrylate | 0.0005 | |
| Resin B-10 | Styrene | 99.9995 | 10.2 |
| | Butyl acrylate | 0.0005 | |

TABLE 2-continued

| Formulations of coating resin B | | | |
|---|---|---|---|
| | Monomers | | Weight average |
| | Constituting monomers | Amount added % by mass | molecular weight (Mw × $10^3$) |
| Resin B-11 | Styrene | 100.0000 | 10.2 |
| | Butyl acrylate | 0.0000 | |
| Resin B-12 | Styrene | 0.0000 | 10.2 |
| | Butyl acrylate | 100.0000 | |

Production Example of Magnetic Carrier Core 1

Step 1 (Weighing and Mixing Step)

| | |
|---|---|
| $Fe_2O_3$ | 68.3% by mass |
| $MnCO_3$ | 28.5% by mass |
| $Mg(OH)_2$ | 2.0% by mass |
| $SrCO_3$ | 1.2% by mass |

The ferrite raw materials were weighed, 20 parts of water was added to 80 parts of the ferrite raw materials, and then wet mixing was performed with a ball mill using zirconia having a diameter (ϕ)) of 10 mm for 3 h to prepare a slurry. The solid fraction concentration of the slurry was 80% by mass.

Step 2 (Pre-baking Step)

The mixed slurry was dried by a spray dryer (manufactured by Ohkawara Kakohki Co., Ltd.), and then baked for 3.0 h at a temperature of 1050° C. in a nitrogen atmosphere (oxygen concentration 1.0% by volume) in a batch electric furnace to produce a pre-baked ferrite.

Step 3 (Pulverization Step)

After the pre-baked ferrite was pulverized to about 0.5 mm with a crusher, water was added to prepare a slurry. The solid fraction concentration of the slurry was 70% by mass. Pulverization was then performed for 3 h in a wet ball mill using ⅛ inch stainless steel beads to obtain a slurry. The slurry was then pulverized for 4 h in a wet bead mill using zirconia with a diameter of 1 mm to obtain a pre-baked ferrite slurry having a 50% particle diameter (D50) of 1.3 μm on a volume basis.

Step 4 (Granulation Step)

After adding 1.0 part of ammonium polycarboxylate as a dispersant and 1.5 parts of polyvinyl alcohol as a binder to 100 parts of the pre-baked ferrite slurry, pulverization and drying were performed with a spray dryer (manufactured by Ohkawara Kakohki Co., Ltd.) to obtain spherical particles. The obtained granulated product was adjusted in particle size, and then heated at 700° C. for 2 h by using a rotary electric furnace to remove organic substances such as the dispersant, the binder and the like.

Step 5 (Baking Step)

Baking was performed in a nitrogen atmosphere (oxygen concentration: 1.0% by volume) by setting the time from room temperature to the baking temperature (1100° C.) to 2 h and holding at a temperature of 1100° C. for 4 h. Thereafter, the temperature was lowered to 60° C. over 8 h, the nitrogen atmosphere was returned to the air atmosphere, and the particles were removed at a temperature of 40° C. or less.

Step 6 (Sorting Step)

After the aggregated particles were disintegrated, sieving was performed with a sieve of 150 μm to remove coarse particles, air classification was performed to remove fine particles, and low-magnetic components were further removed by magnetic separation to obtain porous magnetic core particles 1.

A total of 100 parts of the porous magnetic core particles 1 was placed in a stirring vessel of a mixing stirrer (all-purpose stirrer NDMV type manufactured by Dalton Co., Ltd.), the temperature was maintained at 60° C., and 5 parts of a filling resin including 95% by mass of a methyl silicone oligomer and 5.0% by mass of γ-aminopropyltrimethoxysilane was added dropwise under normal pressure.

After completion of the dropwise addition, stirring was continued while adjusting the time, the temperature was raised to 70° C., and the particles of each porous magnetic core were filled with the resin composition.

The resin-filled magnetic core particles obtained after cooling were transferred to a mixer (drum mixer UD-AT type manufactured by Sugiyama Heavy Industries, Ltd.) having a spiral blade in a rotatable mixing container, and the temperature was raised, under stirring, to 140° C. at a temperature rise rate of 2° C/min under a nitrogen atmosphere. Then, heating and stirring were continued at 140° C. for 50 min.

After cooling to room temperature, the resin-filled and cured ferrite particles were taken out and nonmagnetic substances were removed using a magnetic separator. Furthermore, coarse particles were removed by a vibrating screen to obtain a magnetic carrier core 1 filled with a resin.

Production Example of Magnetic Carrier Core 2

A total of 4.0 parts of a silane coupling agent (3-(2-aminoethylamino)propyltrimethoxysilane) was added to 100.0 parts of magnetite powder having a number average particle diameter of 0.30 μm, and fine particles were treated by high speed mixing and stirring at 100° C. or higher.

| | |
|---|---|
| Phenol | 10 parts |
| Formaldehyde solution (formaldehyde 40%, methanol 10%, water 50%) | 6 parts |
| Treated magnetite | 84 parts |

The above materials, 5 parts of 28% ammonia water and 20 parts of water were placed in a flask, heated and held at 85° C. for 30 min while stirring and mixing to conduct a polymerization reaction for 3 h and cure the generated phenol resin. Thereafter, the cured phenol resin was cooled to 30° C., water was further added, the supernatant was removed, and the precipitate was washed with water and then air dried. Subsequently, drying was performed at a temperature of 60° C. under reduced pressure (5 mm Hg or less) to obtain a spherical magnetic carrier core 2 in a state with a dispersed magnetic substance.

Production Example of Magnetic Carrier 1

| | |
|---|---|
| Magnetic carrier core 1 | 100 parts |
| Resin A-1 | 1.40 parts |
| Resin B-1 | 0.60 parts |

The coating resins of the abovementioned numbers of parts, with respect to 100 parts of the magnetic carrier core 1, were diluted with toluene so that the resin component was 5%, and a sufficiently stirred resin solution was prepared. Thereafter, the magnetic carrier core 1 was placed in a planetary motion mixer (NAUTA MIXER VN type manufactured by Hosokawa Micron Corporation) maintained at a temperature of 60° C., and the above resin solution was charged. As a method of charging, half of the resin solution was charged, and a solvent removal and coating operation was performed for 30 min. Then, another half of the resin solution was charged, and the solvent removal and coating operation was performed for 40 min.

Thereafter, the magnetic carrier coated with the resin coating layer was transferred to a mixer (drum mixer UD-AT type manufactured by Sugiyama Heavy Industries, Ltd.) having spiral blades in a rotatable mixing container, and heat treated for 2 h at the temperature of 120° C. under nitrogen atmosphere while stirring by rotating at 10 rev/min. The resulting magnetic carrier was separated from low magnetic force products by magnetic separation, passed through a sieve with an opening of 150 μm, and then classified with an air classifier to obtain a magnetic carrier 1.

As a result of separating the coating resin of the obtained magnetic carrier 1 and measuring with a GPC measuring device, a peak was obtained in the molecular weight distribution as shown in Table 3.

Production Example of Magnetic Carriers 2 to 26

Magnetic carriers 2 to 26 were obtained in the same manner as in Magnetic Carrier Production Example 1 except that the types of materials and the addition amounts were changed as shown in Table 3.

TABLE 3

Formulations and physical properties of magnetic carriers

| Magnetic carrier No. | Magnetic carrier core No. | Coating resin A | Coated amount (parts) | MA (% by mass) | Coating resin B | Coated amount (parts) | MB (% by mass) | Total amount of coating resin (parts) | PB ($\times 10^3$) | PA ($\times 10^4$) |
|---|---|---|---|---|---|---|---|---|---|---|
| 1 | 1 | A1 | 1.40 | 70.0 | B1 | 0.60 | 30.0 | 2.00 | 2.7 | 3.8 |
| 2 | 2 | A1 | 1.40 | 70.0 | B1 | 0.60 | 30.0 | 2.00 | 2.7 | 3.8 |
| 3 | 1 | A2 | 1.60 | 80.0 | B1 | 0.40 | 20.0 | 2.00 | 2.7 | 5.6 |
| 4 | 1 | A3 | 1.20 | 60.0 | B1 | 0.80 | 40.0 | 2.00 | 2.7 | 2.9 |
| 5 | 1 | A4 | 1.80 | 90.0 | B1 | 0.20 | 10.0 | 2.00 | 2.7 | 3.8 |
| 6 | 1 | A5 | 1.00 | 50.0 | B1 | 1.00 | 50.0 | 2.00 | 2.7 | 3.8 |
| 7 | 1 | A6 | 1.98 | 99.0 | B1 | 0.02 | 1.0 | 2.00 | 2.7 | 3.8 |
| 8 | 1 | A7 | 0.20 | 10.0 | B1 | 1.80 | 90.0 | 2.00 | 2.7 | 3.8 |
| 9 | 1 | A6 | 1.99 | 99.5 | B2 | 0.01 | 0.5 | 2.00 | 1.8 | 3.8 |
| 10 | 1 | A6 | 0.10 | 5.0 | B3 | 1.90 | 95.0 | 2.00 | 3.7 | 3.8 |
| 11 | 1 | A8 | 1.99 | 99.5 | B4 | 0.01 | 0.5 | 2.00 | 1.4 | 3.8 |
| 12 | 1 | A9 | 1.99 | 99.5 | B5 | 0.01 | 0.5 | 2.00 | 9.0 | 3.8 |
| 13 | 1 | A9 | 1.99 | 99.5 | B6 | 0.01 | 0.5 | 2.00 | 9.0 | 3.8 |
| 14 | 1 | A9 | 1.99 | 99.5 | B7 | 0.01 | 0.5 | 2.00 | 1.4 | 3.8 |
| 15 | 1 | A10 | 1.99 | 99.5 | B6 | 0.01 | 0.5 | 2.00 | 9.0 | 7.0 |
| 16 | 1 | A11 | 1.99 | 99.5 | B6 | 0.01 | 0.5 | 2.00 | 9.0 | 2.5 |
| 17 | 1 | A12 | 1.99 | 99.5 | B7 | 0.01 | 0.5 | 2.00 | 1.0 | 7.0 |
| 18 | 1 | A13 | 1.99 | 99.5 | B8 | 0.01 | 0.5 | 2.00 | 9.5 | 7.0 |
| 19 | 1 | A14 | 1.99 | 99.5 | B7 | 0.01 | 0.5 | 2.00 | 1.0 | 2.0 |
| 20 | 1 | A15 | 1.99 | 99.5 | B8 | 0.01 | 0.5 | 2.00 | 9.5 | 7.5 |
| 21 | 1 | A14 | 1.99 | 99.5 | B9 | 0.01 | 0.5 | 2.00 | 0.5 | 2.0 |
| 22 | 1 | A15 | 1.99 | 99.5 | B10 | 0.01 | 0.5 | 2.00 | 10.0 | 7.5 |
| 23 | 1 | A15 | 1.99 | 99.5 | B11 | 0.01 | 0.5 | 2.00 | 10.0 | 7.5 |
| 24 | 1 | A15 | 1.99 | 99.5 | B12 | 0.01 | 0.5 | 2.00 | 10.0 | 7.5 |
| 25 | 1 | A16 | 1.99 | 99.5 | B10 | 0.01 | 0.5 | 2.00 | 10.0 | 7.5 |
| 26 | 1 | A17 | 1.99 | 99.5 | B10 | 0.01 | 0.5 | 2.00 | 10.0 | 7.5 |

In the table, "PB" denotes "Peak molecular weight derived from resin B" and "PA" denotes "Peak molecular weight derived from resin A".

Production Example of Toner

| | |
|---|---|
| Binder resin (polyester having Tg: 57° C., acid value: 12 mg KOH/g, and hydroxyl value: 15 mg KOH/g) | 100 parts |
| C. I. Pigment Blue 15:3 | 5.5 parts |
| 3,5-Di-t-butyl salicylate aluminum compound | 0.2 part |
| Normal paraffin wax (melting point: 90° C.) | 6 parts |

Materials of the above formulation were thoroughly mixed with a Henschel mixer (FM-75J, manufactured by Nippon Coke Industry Co., Ltd.), and then kneaded with a twin-screw kneader (trade name: PCM-30, manufactured by Ikegai Iron and Steel Co., Ltd.) set at a temperature of 130° C. at a feed amount of 10 kg/h (kneaded product temperature at discharge was 150° C.). The resulting kneaded product was cooled, coarsely pulverized with a hammer mill, and then finely pulverized with a mechanical pulverizer (trade name: T-250, manufactured by Turbo Kogyo Co., Ltd.) at a feed amount of 15 kg/h. The particles obtained had a weight average particle diameter of 5.5 μm and included 55.6% by number of particles having a particle diameter of 4.0 μm or less and 0.8% by volume of particles having a particle diameter of 10.0 μm or more.

The obtained particles were classified using a rotary classifier (trade name: TTSP 100, manufactured by Hosokawa Micron Corporation) to cut fine powder and coarse powder. Cyan toner particles 1 were obtained which had a weight average particle diameter of 6.0 μm, a presence ratio of 27.8% by number of particles having a particle diameter of 4.0 μm or less, and a presence ratio of 2.2% by volume of particles having a particle diameter of 10.0 μm or more.

Furthermore, the following materials were introduced into a Henschel mixer (trade name: Model FM-75J, manufactured by Nippon Coke Industry Co., Ltd.), the peripheral speed of the rotating blades was set to 35.0 (m/s), and mixing was performed for 3 min to adhere silica particles, titanium oxide particles and strontium titanate particles to the surface of the cyan toner particles 1 and obtain a cyan toner 1.

| | |
|---|---|
| Cyan toner particles 1: | 100 parts |
| Silica particles: (silica particles prepared by the fumed method were surface-treated with 1.5% by mass of hexamethyldisilazane and then adjusted to a desired particle size distribution by classification) | 3.5 parts |
| Titanium oxide particles (metatitanic acid having anatase type crystallinity was surface-treated with an octylsilane compound) | 0.5 parts |
| Strontium titanate particles: | 0.5 parts |

(Surface-Treated with an Octylsilane Compound)

The materials were shaken with a shaker (YS-8D: manufactured by Yayoi Corporation) so that the toner concentration was 8% by mass by using the magnetic carriers 1 to 25 and toner 1 to prepare 300 g of a two-component developer. The amplitude condition of the shaker was 200 rpm for 2 min.

Meanwhile, 90 parts of toner 1 was added to 10 parts of each of magnetic carriers 1 to 25 and mixed for 5 min with a V-type mixer in an environment of normal temperature and humidity 23° C/50% RH to obtain a replenishing developer. The details of the two-component developer are shown in Table 4, and the details of the replenishing developer are shown in Table 5.

TABLE 4

| Two-component developer | | |
|---|---|---|
| | Magnetic carrier | Toner |
| Two-component developer 1 | Magnetic carrier 1 | Toner 1 |
| Two-component developer 2 | Magnetic carrier 2 | Toner 1 |
| Two-component developer 3 | Magnetic carrier 3 | Toner 1 |
| Two-component developer 4 | Magnetic carrier 4 | Toner 1 |
| Two-component developer 5 | Magnetic carrier 5 | Toner 1 |
| Two-component developer 6 | Magnetic carrier 6 | Toner 1 |
| Two-component developer 7 | Magnetic carrier 7 | Toner 1 |
| Two-component developer 8 | Magnetic carrier 8 | Toner 1 |
| Two-component developer 9 | Magnetic carrier 9 | Toner 1 |
| Two-component developer 10 | Magnetic carrier 10 | Toner 1 |
| Two-component developer 11 | Magnetic carrier 11 | Toner 1 |
| Two-component developer 12 | Magnetic carrier 12 | Toner 1 |
| Two-component developer 13 | Magnetic carrier 13 | Toner 1 |
| Two-component developer 14 | Magnetic carrier 14 | Toner 1 |
| Two-component developer 15 | Magnetic carrier 15 | Toner 1 |
| Two-component developer 16 | Magnetic carrier 16 | Toner 1 |
| Two-component developer 17 | Magnetic carrier 17 | Toner 1 |
| Two-component developer 18 | Magnetic carrier 18 | Toner 1 |
| Two-component developer 19 | Magnetic carrier 19 | Toner 1 |
| Two-component developer 20 | Magnetic carrier 20 | Toner 1 |
| Two-component developer 21 | Magnetic carrier 21 | Toner 1 |
| Two-component developer 22 | Magnetic carrier 22 | Toner 1 |
| Two-component developer 23 | Magnetic carrier 23 | Toner 1 |
| Two-component developer 24 | Magnetic carrier 24 | Toner 1 |
| Two-component developer 25 | Magnetic carrier 25 | Toner 1 |
| Two-component developer 26 | Magnetic carrier 26 | Toner 1 |

TABLE 5

| Replenishing developer | | |
|---|---|---|
| | Magnetic carrier | Toner |
| Replenishing developer 1 | Magnetic carrier 1 | Toner 1 |
| Replenishing developer 2 | Magnetic carrier 2 | Toner 1 |
| Replenishing developer 3 | Magnetic carrier 3 | Toner 1 |
| Replenishing developer 4 | Magnetic carrier 4 | Toner 1 |
| Replenishing developer 5 | Magnetic carrier 5 | Toner 1 |
| Replenishing developer 6 | Magnetic carrier 6 | Toner 1 |
| Replenishing developer 7 | Magnetic carrier 7 | Toner 1 |
| Replenishing developer 8 | Magnetic carrier 8 | Toner 1 |
| Replenishing developer 9 | Magnetic carrier 9 | Toner 1 |
| Replenishing developer 10 | Magnetic carrier 10 | Toner 1 |
| Replenishing developer 11 | Magnetic carrier 11 | Toner 1 |
| Replenishing developer 12 | Magnetic carrier 12 | Toner 1 |
| Replenishing developer 13 | Magnetic carrier 13 | Toner 1 |
| Replenishing developer 14 | Magnetic carrier 14 | Toner 1 |
| Replenishing developer 15 | Magnetic carrier 15 | Toner 1 |
| Replenishing developer 16 | Magnetic carrier 16 | Toner 1 |
| Replenishing developer 17 | Magnetic carrier 17 | Toner 1 |
| Replenishing developer 18 | Magnetic carrier 18 | Toner 1 |
| Replenishing developer 19 | Magnetic carrier 19 | Toner 1 |
| Replenishing developer 20 | Magnetic carrier 20 | Toner 1 |
| Replenishing developer 21 | Magnetic carrier 21 | Toner 1 |
| Replenishing developer 22 | Magnetic carrier 22 | Toner 1 |
| Replenishing developer 23 | Magnetic carrier 23 | Toner 1 |
| Replenishing developer 24 | Magnetic carrier 24 | Toner 1 |
| Replenishing developer 25 | Magnetic carrier 25 | Toner 1 |
| Replenishing developer 26 | Magnetic carrier 26 | Toner 1 |

Examples 1 to 20 and Comparative Examples 1 to 6

The following evaluation was performed using the obtained two-component developers and replenishing developers.

As an image forming apparatus, a modified color copying machine imagePRESS C850 by Canon Inc. was used.

A two-component developer was placed in each color developing device, replenishing developer containers including the developer for each color replenishment were set, an image was formed, and various evaluations were conducted before and after a durability test.

As a durability test, a chart of FFH output with an image ratio of 1% was used under a printing environment of temperature 23° C./humidity 5 RH % (hereinafter "N/L").

Further, under the printing environment of temperature 30° C./humidity 80 RH % (hereinafter "H/H"), a chart of FFH output with an image ratio of 1% and a chart of FFH output with an image ratio of 40% were used. FFH, as referred to herein, is a value representing 256 gradations in hexadecimal, 00h being the first gradation (white area) of 256 gradations, and FFH being the 256-th gradation (solid part) of 256 gradations.

The number of image output prints was 50,000 for each environment. Conditions

Paper: laser beam printer paper CS-814 (81.4 g/m$^2$) (Canon Marketing Japan Co., Ltd.)

Image formation speed: A4 size, full color 85 prints/min

Development conditions: the modification was such that the development contrast could be adjusted to an arbitrary value, and the automatic correction by the main body could not be operated. The modification also made it possible to change the peak-to-peak voltage (Vpp) of the alternating electric field in increments of 0.1 kV from Vpp of 0.7 kV to 1.8 kV at a frequency of 2.0 kHz. The modification also made it possible to obtain an image in a single color for each color.

Each evaluation item is shown below.

(1) Image Density Change Under H/H Environment

An FFH image (toner laid-on level on paper: 0.35 mg/cm$^2$) of a size of 15 mm×15 mm was outputted to A4 size paper (CS-814) under H/H environment in a total of 9 locations at the center and edge of the paper, and the density in the central portion of each image was measured by an X-Rite color reflection densitometer (Color reflection densitometer X-Rite 404A). The average value of the obtained image densities was taken as Ds.

Furthermore, after conducting the endurance test with a chart of FFH output with an image ratio of 1% in the H/H environment, evaluation images were outputted in the same manner as before the endurance test, and the average value of the obtained image densities was taken as $D1_1$.

In addition, after conducting the endurance test with a chart of FFH output with an image ratio of 40% in the H/H environment, evaluation images were outputted in the same manner as before the endurance test, and the average value of the obtained image densities was taken as $D1_2$.

From the average values of the obtained image densities, $D_1$ and $D_2$ were determined according to the following formulas, and evaluated according to the following criteria. The evaluation results are shown in Table 6.

$$D_1 = D1_1 - Ds$$

$$D_2 = D1_2 - Ds$$

Evaluation Criteria

A: $0.00 \leq |Dx| \leq 0.02$

B: $0.02 < |Dx| \leq 0.05$

C: $0.05 < |Dx| \leq 0.08$

D: $0.08 < |Dx| \leq 0.10$

E: $0.10 < |Dx| \leq 0.13$

F: $0.13 < |Dx| \leq 0.15$

G: $0.15 < |Dx| \leq 0.20$

H: $0.20 < |Dx|$ (x is 1or 2)

(2) Evaluation of Fine Line Reproducibility

After conducting the above-mentioned endurance test with a chart of FFH output with an image ratio of 1% in the H/H environment, five FFH images with an image ratio of 100% were outputted. Furthermore, three evaluation images in which ten 0.25 pt fine lines parallel to the printing direction were arranged at equal intervals were outputted. In the obtained evaluation image, the number of fine lines having scattering and breaks was evaluated according to the following criteria. The evaluation results are shown in Table 6.

Evaluation Criteria

A: 0

B: from 1 to 2

C: from 3 to 4

D: from 5 to 6

E: from 7 to 8

F: from 9 to 10

G: from 11 to 15

H: 16 or more (3) Image Density Change Under N/L Environment

An FFH image (toner laid-on level on paper: 0.35 mg/cm$^2$) of a size of 15 mm×15 mm was outputted to A4 size paper (CS-814) under N/L environment in a total of 9 locations at the center and edge of the paper, and the density in the central portion of each image was measured by an X-Rite color reflection densitometer (Color reflection densitometer X-Rite 404A). The average value of the obtained image densities was taken as Ds.

Furthermore, after conducting the endurance test with a chart of FFH output with an image ratio of 1% in the N/L environment, evaluation images were outputted in the same manner as before the endurance test, and the average value of the obtained image densities was taken as $D1_3$. From the average value of the obtained image densities, $D_3$ was determined according to the following formula, and evaluated according to the following criteria. The evaluation results are shown in Table 6.

$$D_3 = D1_3 - Ds$$

Evaluation Criteria

A: $0.00 \leq |D_3| \leq 0.02$

B: $0.02 < |D_3| \leq 0.05$

C: $0.05 < |D_3| \leq 0.08$

D: $0.08 < |D_X| \leq 0.10$

E: $0.10 < |D_3| \leq 0.13$

F: $0.13 < |D_3| \leq 0.15$

G: $0.15 < |D_3| \leq 0.20$

H: $0.20 < |D_3|$ (4) Evaluation of In-Plane Uniformity

After conducting the endurance test under the conditions described above in the N/L environment, five FFH images with an image ratio of 100% were outputted. Furthermore, an FFH image (toner laid-on level on paper: 0.35 mg/cm$^2$) of a size of 200 mm×280 mm was outputted to A4 size paper (CS-814), and the obtained image was divided into 140 sections of a size of 20 mm×20 mm. The density at the center of each image was measured by an X-Rite color reflection densitometer (Color reflection densitometer X-Rite 404A). Among the obtained image densities, the largest was denoted by Dmax and the smallest was denoted by Dmin, and the difference Dmax−Dmin was calculated to evaluate the in-plane uniformity according to the following criteria. The evaluation results are shown in Table 6.

Evaluation Criteria

A: $0.00 \leq Dmax - Dmin \leq 0.02$

B: $0.02 < Dmax - Dmin \leq 0.05$

C: $0.05 < Dmax - Dmin \leq 0.08$

D: $0.08 < Dmax - Dmin \leq 0.10$

E: $0.10 < Dmax - Dmin \leq 0.13$

F: $0.13 < Dmax - Dmin < 0.15$

G: $0.15 < Dmax - Dmin < 0.20$

H: $0.20 < Dmax - Dmin$ (5) Overall Determination

The evaluation ranks in the evaluation items (1) to (4) were quantified, and the total value was determined according to the following criteria.

In the evaluation items (1) to (4), A=8, B=7, C=6, D=5, E=4, F=3, G=2, and H=1.

It was determined that the effects of the present invention were obtained when the total value of the overall determination was 20 or more.

The results are shown in Table 6.

TABLE 6

| Evaluation results | | | | | | | | | | | | | |
|---|---|---|---|---|---|---|---|---|---|---|---|---|---|
| | Two- | | IC H/H | | | | | | | | In-plane | | |
| | component | Replenishing | 40% | | 1% | | Fine line | | IC N/L | | uniformity | | |
| Example | developer | developer | Density | | Density | | reproducibility | | Density | | Density | | Overall |
| No. | No. | No. | difference | Rank | difference | Rank | N | Rank | difference | Rank | difference | Rank | evaluation |
| 1 | 1 | 1 | 0.00 | A | 0.01 | A | 0 | A | 0.00 | A | 0.00 | A | 40 |
| 2 | 2 | 2 | 0.00 | A | 0.01 | A | 0 | A | 0.00 | A | 0.01 | A | 40 |
| 3 | 3 | 3 | 0.00 | A | 0.01 | A | 0 | A | 0.00 | A | 0.03 | B | 39 |
| 4 | 4 | 4 | 0.01 | A | 0.02 | A | 1 | B | 0.01 | A | 0.01 | A | 39 |
| 5 | 5 | 5 | 0.01 | A | 0.02 | A | 0 | A | 0.03 | B | 0.04 | B | 38 |
| 6 | 6 | 6 | 0.02 | A | 0.03 | B | 1 | B | 0.01 | A | 0.02 | A | 38 |
| 7 | 7 | 7 | 0.02 | A | 0.02 | A | 0 | A | 0.03 | B | 0.06 | C | 37 |
| 8 | 8 | 8 | 0.02 | A | 0.03 | B | 3 | C | 0.02 | A | 0.02 | A | 37 |
| 9 | 9 | 9 | 0.02 | A | 0.02 | A | 2 | B | 0.04 | B | 0.06 | C | 36 |
| 10 | 10 | 10 | 0.03 | B | 0.04 | B | 3 | C | 0.02 | A | 0.02 | A | 36 |
| 11 | 11 | 11 | 0.03 | B | 0.04 | B | 2 | B | 0.05 | B | 0.06 | C | 34 |
| 12 | 12 | 12 | 0.04 | B | 0.05 | B | 2 | B | 0.06 | C | 0.07 | C | 33 |
| 13 | 13 | 13 | 0.05 | B | 0.06 | C | 2 | B | 0.06 | C | 0.08 | C | 32 |
| 14 | 14 | 14 | 0.06 | C | 0.09 | D | 3 | C | 0.07 | C | 0.08 | C | 29 |
| 15 | 15 | 15 | 0.07 | C | 0.07 | C | 4 | C | 0.09 | D | 0.09 | D | 28 |
| 16 | 16 | 16 | 0.07 | C | 0.10 | D | 4 | C | 0.09 | D | 0.10 | D | 27 |
| 17 | 17 | 17 | 0.09 | D | 0.11 | E | 5 | D | 0.10 | D | 0.10 | D | 24 |
| 18 | 18 | 18 | 0.08 | C | 0.08 | C | 4 | C | 0.11 | E | 0.11 | E | 26 |

TABLE 6-continued

| Evaluation results | | | | | | | | | | | | | |
|---|---|---|---|---|---|---|---|---|---|---|---|---|---|
| | Two- | | IC H/H | | | | | | | | In-plane | | |
| | component | Replenishing | 40% | | 1% | | Fine line | | IC N/L | | uniformity | | |
| Example | developer | developer | Density | | Density | | reproducibility | | Density | | Density | | Overall |
| No. | No. | No. | difference | Rank | difference | Rank | N | Rank | difference | Rank | difference | Rank | evaluation |
| 19 | 19 | 19 | 0.11 | E | 0.14 | E | 8 | E | 0.12 | E | 0.13 | E | 20 |
| 20 | 20 | 20 | 0.08 | C | 0.08 | C | 8 | E | 0.14 | F | 0.15 | F | 22 |
| C.E. 1 | 21 | 21 | 0.14 | F | 0.16 | G | 11 | G | 0.16 | G | 0.16 | G | 11 |
| C.E. 2 | 22 | 22 | 0.09 | D | 0.14 | F | 12 | G | 0.16 | G | 0.17 | G | 14 |
| C.E. 3 | 23 | 23 | 0.10 | D | 0.15 | F | 14 | G | 0.22 | H | 0.22 | H | 12 |
| C.E. 4 | 24 | 24 | 0.16 | G | 0.21 | H | 16 | H | 0.17 | G | 0.18 | G | 8 |
| C.E. 5 | 25 | 25 | 0.17 | G | 0.22 | H | 18 | H | 0.20 | G | 0.19 | G | 8 |
| C.E. 6 | 26 | 26 | 0.21 | H | 0.24 | H | 19 | H | 0.21 | H | 0.22 | H | 5 |

In the table, C.E. denotes "Comparative Example", "IC H/H" denotes "Image density change under H/H environment", N denotes "Number of fine lines with scattering and breaks", and "IC N/L" denotes "Image density change under N/L environment".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-149543, filed Aug. 8, 2018, which is hereby incorporated by reference herein in its entirety.

What is claimed is:

1. A magnetic carrier including a magnetic carrier particle having a magnetic carrier core and a resin coating layer formed on a surface of the magnetic carrier core, wherein the resin coating layer includes a resin component including a resin A and a resin B, the resin A is a copolymer of monomers including (a) a (meth)acrylic acid ester monomer having an alicyclic hydrocarbon group, and (b) a macromonomer containing a polymer portion and a reactive portion bound to the polymer portion, wherein the polymer portion has a polymer of at least one monomer selected from the group consisting of methyl acrylate, methyl methacrylate, butyl acrylate, butyl methacrylate, 2-ethylhexyl acrylate and 2-ethylhexyl methacrylate, and the reactive portion has a reactive C—C double bond, the resin B is a copolymer of monomers including (c) a styrene-based monomer, and (d) a (meth)acrylic acid ester monomer represented by a following formula (1), and in a molecular weight distribution of a tetrahydrofuran soluble component of the resin component contained in the resin coating layer, a peak derived from the resin B is present in a molecular weight range of from 1000 to 9500,

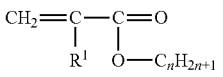

(1)

in the formula (1), $R^1$ represents H or $CH_3$, and n represents an integer of from 2 to 8.

2. The magnetic carrier according to claim 1, wherein in the molecular weight distribution of a tetrahydrofuran soluble component of the resin component contained in the resin coating layer, which is determined by gel permeation chromatography, a peak derived from the resin A is present in a molecular weight range of from 25,000 to 70,000.

3. The magnetic carrier according to claim 1, wherein a weight average molecular weight Mw of the macromonomer determined by gel permeation chromatography is from 1000 to 9500.

4. The magnetic carrier according to claim 1, wherein when, among the monomers for forming the resin A, a ratio of the (meth)acrylic acid ester monomer having an alicyclic hydrocarbon group is denoted by Ma (% by mass), and a ratio of the macromonomer is denoted by Mb (% by mass), Ma and Mb satisfy the following relationships:

$$0 \leq Ma \leq 90.0, \text{ and}$$

$$10.0 \leq Mb \leq 50.0.$$

5. The magnetic carrier according to claim 1, wherein when, among the monomers for forming the resin B, a mass-based ratio of the (meth)acrylic acid ester monomer represented by the formula (1) is denoted by Mc (ppm), Mc satisfies the following relationship:

$$5 \leq Mc \leq 6000.$$

6. The magnetic carrier according to claim 1, wherein when the content ratio of the resin A in the resin coating layer is denoted by MA (% by mass) and the content ratio of the resin B in the resin coating layer is denoted by MB (% by mass), the MA and MB satisfy the following relationships:

$$10.0 \leq MA \leq 99.0 \text{ and}$$

$$1.0 \leq MB \leq 90.0.$$

7. The magnetic carrier according to claim 1, wherein the magnetic carrier core is a magnetic body-dispersed resin particle or a porous magnetic core particle.

8. A two-component developer comprising a toner having a toner particle including a binder resin, and a magnetic carrier, wherein the magnetic carrier includes a magnetic carrier particle having a magnetic carrier core and a resin coating layer formed on a surface of the magnetic carrier core, wherein the resin coating layer includes a resin component including a resin A and a resin B, the resin A is a copolymer of monomers including (a) a (meth)acrylic acid ester monomer having an alicyclic hydrocarbon group, and (b) a macromonomer containing a polymer portion and a reactive portion bound to the polymer portion, wherein the polymer portion has a polymer of at least one monomer selected from the group consisting of methyl acrylate, methyl methacrylate, butyl acrylate, butyl methacrylate, 2-ethylhexyl acrylate and 2-ethylhexyl methacrylate, and the reactive portion has a reactive C—C double bond, the resin B is a copolymer of monomers including (c) a styrene-based monomer, and (d) a (meth)acrylic acid ester monomer represented by a following formula (1), and in a molecular weight distribution of a tetrahydrofuran soluble component of the resin component contained in the resin coating layer, a peak derived from the resin B is present in a molecular weight range of from 1000 to 9500,

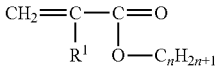

(1)

in the formula (1), $R^1$ represents H or $CH_3$, and n represents an integer of from 2 to 8.

9. An image forming method comprising:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer to form a toner image;

a transfer step of transferring the toner image to a transfer material with or without an intermediate transfer member; and a fixing step of fixing the transferred toner image to the transfer material, wherein the two-component developer comprises a toner having a toner particle including a binder resin, and a magnetic carrier, wherein the magnetic carrier is the magnetic carrier according to claim 1.

10. A replenishing developer for use in an image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which the replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the magnetic carrier according to claim 1.

11. An image forming method which comprises:

a charging step of charging an electrostatic latent image bearing member;

an electrostatic latent image forming step of forming an electrostatic latent image on a surface of the electrostatic latent image bearing member;

a developing step of developing the electrostatic latent image by using a two-component developer in a developing device to form a toner image;

a transfer step of transferring the toner image to a transfer material with or without an intermediate transfer member; and a fixing step of fixing the transferred toner image to the transfer material, and in which a replenishing developer is replenished to the developing device in accordance with a reduction in toner concentration in the two-component developer in the developing device, wherein the replenishing developer includes a magnetic carrier and a toner having a toner particle including a binder resin, the replenishing developer includes from 2 parts by mass to 50 parts by mass of the toner with respect to 1 part by mass of the magnetic carrier, and the magnetic carrier is the magnetic carrier according to claim 1.

* * * * *